US009015962B2

(12) United States Patent
Boudreau et al.

(10) Patent No.: US 9,015,962 B2
(45) Date of Patent: Apr. 28, 2015

(54) ARTICLE OF FOOTWEAR WITH SUPPORT ELEMENT

(75) Inventors: Matthew Boudreau, North Attleboro, MA (US); Daniel Hobson, Waltham, MA (US); Scott Daley, Franklin, MA (US); Bob Bischoff, Attleboro, MA (US)

(73) Assignee: Reebok International Limited, London (GB)

( * ) Notice: Subject to any disclaimer, the term of this patent is extended or adjusted under 35 U.S.C. 154(b) by 1094 days.

(21) Appl. No.: 12/748,246

(22) Filed: Mar. 26, 2010

(65) Prior Publication Data

US 2011/0232130 A1 Sep. 29, 2011

(51) Int. Cl.

| | |
|---|---|
| ***A43B 13/00*** | (2006.01) |
| ***A43B 13/18*** | (2006.01) |
| ***A43B 13/14*** | (2006.01) |

(52) U.S. Cl.

CPC ..... *A43B 13/181* (2013.01); *A43B 13/141* (2013.01); *A43B 13/186* (2013.01)

(58) Field of Classification Search

CPC ... A43B 13/141; A43B 13/143; A43B 13/145
USPC ..... 36/102, 103, 59 R, 35 B, 27, 28, 29, 31, 36/25 R, 35 R, 59 C, 107, 108, 30 A, 30 R
See application file for complete search history.

(56) References Cited

U.S. PATENT DOCUMENTS

| | | | | |
|---|---|---|---|---|
| 485,459 | A | | 11/1892 | Crocker |
| 1,594,056 | A | | 7/1926 | Floyd |
| 1,607,375 | A | | 11/1926 | Whipple |
| D108,320 | S | | 2/1938 | Eldon |
| D133,176 | S | | 7/1942 | Gregg |
| D136,381 | S | | 9/1943 | Ghez et al. |
| D149,139 | S | | 3/1948 | Parker |
| D157,034 | S | | 1/1950 | Eldon |
| 2,580,840 | A | | 1/1952 | Rogndal |
| 2,627,676 | A | | 2/1953 | Hack |
| D173,030 | S | | 9/1954 | Hoza |
| 2,710,461 | A | * | 6/1955 | Hack ..... 36/28 |
| 2,722,756 | A | | 11/1955 | Ecclesine |
| 3,444,632 | A | | 5/1969 | Hack et al. |

(Continued)

FOREIGN PATENT DOCUMENTS

| | | |
|---|---|---|
| DE | 1145961 | 3/1963 |
| EP | 1064861 A1 | 1/2001 |

(Continued)

OTHER PUBLICATIONS

U.S. Appl. No. 12/980,961, Brian Christensen, "Sole and Article of Footwear", filed Dec. 29, 2010.

(Continued)

*Primary Examiner* — Marie Bays
(74) *Attorney, Agent, or Firm* — Sterne, Kessler, Goldstein & Fox P.L.L.C.

(57) ABSTRACT

An article of footwear with an undulating sole provides a different and unique ride and/or feel to the article of footwear, while also providing a unique aesthetic appeal and adequate cushioning and support. The midsole has an undulating shape substantially similar to a sine wave with a series alternating peaks and troughs, and may include one or more support elements disposed on the midsole to provide desired stiffness or cushioning properties to the midsole.

25 Claims, 24 Drawing Sheets

(56) References Cited

U.S. PATENT DOCUMENTS

D233,805 S 12/1974 Kubo
4,071,963 A 2/1978 Fukuoka
4,130,947 A 12/1978 Denu
4,170,078 A * 10/1979 Moss ..... 36/28
D274,574 S 7/1984 Stubblefield
4,561,195 A 12/1985 Onoda et al.
4,642,917 A 2/1987 Ungar
D296,149 S 6/1988 Diaz
4,798,010 A 1/1989 Sugiyama
4,805,319 A 2/1989 Tonkel
4,864,737 A 9/1989 Marrello
D316,324 S 4/1991 Rogers
5,044,096 A 9/1991 Polegato
D324,131 S 2/1992 Lucas
D325,288 S 4/1992 Richard et al.
D326,014 S 5/1992 Issler
D327,362 S 6/1992 Hatfield
D334,282 S 3/1993 Greene
D336,771 S 6/1993 Harfield et al.
D347,516 S 6/1994 Foster
5,319,866 A 6/1994 Foley et al.
5,337,492 A * 8/1994 Anderie et al. ..... 36/28
D356,206 S 3/1995 Martin
D357,346 S 4/1995 Ho
D360,065 S 7/1995 Werman
D364,497 S 11/1995 Schelling
5,469,639 A 11/1995 Sessa
D367,952 S 3/1996 Shea
D378,011 S 2/1997 Lucas
D379,259 S 5/1997 Kayano
D385,987 S 11/1997 Bramani
D390,346 S 2/1998 Loveder
5,713,140 A * 2/1998 Baggenstoss ..... 36/28
D394,945 S 6/1998 Doxey
D395,739 S 7/1998 Mervar
D396,947 S 8/1998 Serna
D397,847 S 9/1998 Hudson
5,799,415 A 9/1998 Kenji et al.
5,822,886 A 10/1998 Luthi et al.
D402,455 S 12/1998 Greenberg
D412,236 S 7/1999 von Contal
5,918,385 A 7/1999 Sessa
D414,316 S 9/1999 Lozano
D415,610 S 10/1999 Cahill
5,987,782 A * 11/1999 Bramani ..... 36/107
6,009,637 A 1/2000 Pavone
D420,497 S 2/2000 Panella
D421,834 S 3/2000 Cooper
D424,287 S 5/2000 Edwards
6,079,125 A 6/2000 Quellais et al.
6,108,943 A 8/2000 Hudson et al.
6,138,385 A 10/2000 Jungkind et al.
6,189,239 B1 2/2001 Gasparovic et al.
6,205,681 B1 3/2001 Kita
6,219,939 B1 4/2001 Kita et al.
6,219,940 B1 4/2001 Kita
D442,357 S 5/2001 Burt
6,226,896 B1 5/2001 Friton
6,289,608 B1 9/2001 Kita et al.
D449,433 S 10/2001 Matis et al.
6,295,741 B1 10/2001 Kita
6,305,100 B1 * 10/2001 Komarnycky et al. ..... 36/3 R
6,311,414 B1 11/2001 Kita
6,314,664 B1 11/2001 Kita et al.
6,338,206 B1 1/2002 Kita
6,389,713 B1 5/2002 Kita
6,393,732 B1 5/2002 Kita
6,401,365 B2 6/2002 Kita et al.
D465,079 S 11/2002 Merceron
6,516,539 B2 2/2003 Nishiwaki et al.
6,557,270 B2 5/2003 Nakano et al.
D475,509 S 6/2003 Avar
6,606,804 B2 8/2003 Kaneko et al.
6,625,905 B2 9/2003 Kita
6,647,645 B2 11/2003 Kita
6,675,500 B1 1/2004 Cadamuro
6,685,011 B2 * 2/2004 Nishiwaki et al. ..... 36/28
6,694,642 B2 2/2004 Turner
6,711,834 B1 * 3/2004 Kita ..... 36/27
D489,525 S 5/2004 Snow et al.
D489,881 S 5/2004 Recchi
D490,599 S 6/2004 Snow et al.
6,754,981 B1 6/2004 Edwards
6,763,611 B1 * 7/2004 Fusco ..... 36/28
D495,128 S 8/2004 Avar
D497,046 S 10/2004 Scott
6,810,605 B2 11/2004 Nakano et al.
D499,247 S 12/2004 Wahoske et al.
6,964,119 B2 11/2005 Weaver, III
D515,305 S 2/2006 Andrews-Kramer
D515,306 S 2/2006 Andrews-Kramer
D516,293 S 3/2006 Smith, III
D523,232 S 6/2006 Shaffer
D523,614 S 6/2006 Mitchell
D523,627 S 6/2006 Avar
D523,628 S 6/2006 Young
7,055,198 B2 6/2006 Cadamuro et al.
D524,034 S 7/2006 Hlavacs
D524,035 S 7/2006 Greene et al.
D524,535 S 7/2006 Cass
7,089,152 B2 8/2006 Oda et al.
D528,753 S 9/2006 Dirsa
D528,776 S 9/2006 Hui
D528,778 S 9/2006 Avar et al.
D529,267 S 10/2006 Portzline
D530,905 S 10/2006 Jonsson
D532,597 S 11/2006 Chan
7,162,815 B2 1/2007 Miyauchi et al.
D537,611 S 3/2007 Matis et al.
D546,532 S 7/2007 Matis et al.
D552,832 S 10/2007 Hardy
D553,837 S 10/2007 Hubbard
D553,846 S 10/2007 Kayano et al.
D555,348 S 11/2007 Bettencourt
D555,891 S 11/2007 Bettencourt
D560,061 S 1/2008 Chan
D560,062 S 1/2008 Chan
D560,063 S 1/2008 Chan
D561,958 S 2/2008 Hahn
D561,985 S 2/2008 Andersen et al.
7,334,349 B2 2/2008 Sokolowshi et al.
7,337,559 B2 3/2008 Russell
D569,594 S 5/2008 Horne et al.
D569,595 S 5/2008 Le
D570,078 S 6/2008 Davis
D574,141 S 8/2008 Kaufman
D574,581 S 8/2008 Cooper
D574,583 S 8/2008 St-Louis et al.
D574,602 S 8/2008 Grenet
D574,603 S 8/2008 McMillan
D574,604 S 8/2008 McMillan
D576,394 S 9/2008 Heller
D578,744 S 10/2008 Earle
7,441,346 B2 10/2008 Hardy et al.
D584,490 S 1/2009 Ong
D586,991 S 2/2009 Fuerst
D586,993 S 2/2009 Banik et al.
D592,383 S 5/2009 Wawrousek
D592,847 S 5/2009 Rosenbaum
D594,195 S 6/2009 Nakano
7,549,236 B2 6/2009 Dillon et al.
D595,937 S 7/2009 Morris
D596,386 S 7/2009 Brambilla
7,556,846 B2 7/2009 Dojan et al.
D599,986 S 9/2009 Reiss
D600,895 S 9/2009 Morgan
D601,334 S 10/2009 Werman
D605,838 S 12/2009 Foust
D607,193 S 1/2010 Recchi
D607,633 S 1/2010 Mongelli
7,644,518 B2 1/2010 Chandler et al.
D609,440 S 2/2010 Morris
D609,441 S 2/2010 Wawrousek
D615,286 S 5/2010 Grote

(56) References Cited

U.S. PATENT DOCUMENTS

| | | | |
|---|---|---|---|
| D615,741 | S | 5/2010 | Matis et al. |
| D616,188 | S | 5/2010 | Chan |
| 7,707,743 | B2 | 5/2010 | Schindler et al. |
| D617,085 | S | 6/2010 | Recchi et al. |
| D617,983 | S | 6/2010 | Raysse |
| 7,762,008 | B1 | 7/2010 | Clark et al. |
| D622,043 | S | 8/2010 | Hauglin |
| 7,784,196 | B1 | 8/2010 | Christensen et al. |
| D624,293 | S | 9/2010 | Recchi et al. |
| D634,922 | S | 3/2011 | Pauk et al. |
| D636,567 | S | 4/2011 | Raysse |
| D637,380 | S | 5/2011 | Niedner et al. |
| 7,946,058 | B2 | 5/2011 | Johnson et al. |
| D641,143 | S | 7/2011 | Niedner et al. |
| D641,545 | S | 7/2011 | Niedner et al. |
| D642,776 | S | 8/2011 | Raysse |
| D643,194 | S | 8/2011 | Raysse |
| D644,419 | S | 9/2011 | Raysse |
| D644,420 | S | 9/2011 | Christopherson |
| D644,824 | S | 9/2011 | Leleu |
| D646,871 | S | 10/2011 | Christopherson |
| 8,056,264 | B2 | 11/2011 | Sato et al. |
| D649,754 | S | 12/2011 | Callahan et al. |
| D652,201 | S | 1/2012 | Vestuti et al. |
| D653,842 | S | 2/2012 | Weiss |
| 8,112,905 | B2 | 2/2012 | Bemis et al. |
| D655,483 | S | 3/2012 | Portzline |
| D655,487 | S | 3/2012 | Blakeslee |
| D655,897 | S | 3/2012 | Mahoney |
| D655,902 | S | 3/2012 | Debiase |
| D656,715 | S | 4/2012 | Katz et al. |
| D656,720 | S | 4/2012 | Wawrousek |
| D657,542 | S | 4/2012 | Duan |
| D657,944 | S | 4/2012 | Casadei |
| 8,146,266 | B2 | 4/2012 | Vattes et al. |
| D659,356 | S | 5/2012 | Van Zyll De Jong et al. |
| D659,362 | S | 5/2012 | Van Zyll De Jong et al. |
| D659,958 | S | 5/2012 | Birkinhead |
| D659,959 | S | 5/2012 | Vestuti et al. |
| D659,964 | S | 5/2012 | Callahan et al. |
| D659,965 | S | 5/2012 | Callahan et al. |
| D660,568 | S | 5/2012 | Blakeslee |
| 8,181,365 | B2 | 5/2012 | Cass et al. |
| D661,476 | S | 6/2012 | Loverin |
| D661,879 | S | 6/2012 | Raysse |
| D661,880 | S | 6/2012 | Raysse |
| D662,293 | S | 6/2012 | Christopherson |
| D662,295 | S | 6/2012 | Raysse |
| D662,301 | S | 6/2012 | Raysse |
| D662,697 | S | 7/2012 | Portzline |
| D662,699 | S | 7/2012 | Callahan et al. |
| D662,700 | S | 7/2012 | Raysse |
| D663,929 | S | 7/2012 | Teng-Lee |
| D666,390 | S | 9/2012 | Van Zyll De Jong et al. |
| D667,204 | S | 9/2012 | Campbell et al. |
| D667,617 | S | 9/2012 | Spring |
| D667,618 | S | 9/2012 | Raysse |
| D667,619 | S | 9/2012 | Blakeslee |
| D668,028 | S | 10/2012 | Pope |
| D668,029 | S | 10/2012 | Vestuti et al. |
| D669,255 | S | 10/2012 | Birkenhead |
| D674,581 | S | 1/2013 | Callahan et al. |
| D674,996 | S | 1/2013 | Sallee |
| D674,997 | S | 1/2013 | Callahan et al. |
| D675,003 | S | 1/2013 | Leon et al. |
| 2001/0008053 | A1 | 7/2001 | Belli |
| 2003/0101621 | A1 | 6/2003 | Nishiwaki et al. |
| 2004/0154189 | A1 | 8/2004 | Wang |
| 2006/0137227 | A1 | 6/2006 | Kita et al. |
| 2006/0277792 | A1 | 12/2006 | Schoenborn |
| 2006/0283045 | A1 | 12/2006 | Kita et al. |
| 2007/0209230 | A1 | 9/2007 | Dillon et al. |
| 2007/0266593 | A1* | 11/2007 | Schindler et al. ..... 36/28 |
| 2008/0052965 | A1 | 3/2008 | Sato |
| 2008/0066347 | A1 | 3/2008 | Suzuki |
| 2008/0120871 | A1 | 5/2008 | Sato et al. |
| 2008/0229617 | A1 | 9/2008 | Johnson et al. |
| 2008/0276491 | A1 | 11/2008 | Gaensler et al. |
| 2008/0289224 | A1* | 11/2008 | Sink ..... 36/103 |
| 2009/0013559 | A1 | 1/2009 | Chan et al. |
| 2010/0175280 | A1 | 7/2010 | Rinehart, Jr. et al. |
| 2010/0192420 | A1 | 8/2010 | Favraud |
| 2010/0269376 | A1 | 10/2010 | Flannery et al. |
| 2010/0325917 | A1 | 12/2010 | Cass et al. |
| 2011/0016746 | A1 | 1/2011 | Callahan et al. |
| 2011/0016749 | A1 | 1/2011 | Callahan et al. |
| 2011/0232130 | A1 | 9/2011 | Boudreau et al. |
| 2011/0277351 | A1 | 11/2011 | Scoledes |
| 2011/0289799 | A1 | 12/2011 | Keating et al. |
| 2012/0000095 | A1 | 1/2012 | Torrance |
| 2012/0055047 | A1 | 3/2012 | Youngs |
| 2012/0073160 | A1 | 3/2012 | Marvin et al. |

FOREIGN PATENT DOCUMENTS

| | | |
|---|---|---|
| JP | 11000203 | 1/1999 |
| JP | 11235202 | 8/1999 |
| JP | 2001275711 | 10/2001 |
| JP | 2002336003 | 11/2002 |
| JP | 2003339405 | 12/2003 |
| JP | 2004173884 | 6/2004 |
| JP | 2004267516 | 9/2004 |
| JP | 2005253578 | 9/2005 |

OTHER PUBLICATIONS

Extended European Search Report for Application No. EP 11194626.5, Applicant: Reebok International Limited, mailed May 8, 2012, 6 pages.

U.S. Appl. No. 29/411,762, Hardigan et al., "Portion of a Shoe Sole", filed Jan. 25, 2012.

U.S. Appl. No. 29/416,617, Davis et al., "Portion of a Shoe", filed Mar. 23, 2012.

U.S. Appl. No. 13/428,897, Davis et al., "Articles of Footwear", filed Mar. 23, 2012.

U.S. Appl. No. 29/418,772, Vestuti et al., "Portion of a Shoe", filed Apr. 20, 2012.

U.S. Appl. No. 29/419,638, Birkinhead, "Portion of a Shoe", filed Apr. 30, 2012.

U.S. Appl. No. 29/419,900, Callahan et al., "Portion of a Shoe", filed May 5, 2012.

U.S. Appl. No. 29/419,905, Callahan et al., "Portion of a Shoe", filed May 2, 2012.

Office Action dated Apr. 27, 2012 from U.S. Appl. No. 12/506,957, Callahan et al., Article of Footwear Having an Undulating Sole, filed Jul. 21, 2009.

Office Action dated Apr. 25, 2012 from U.S. Appl. No. 12/832,464, Callahan et al., Article of Footwear and Methods of Making Same, filed Jul. 8, 2010.

K-Swiss, Inc. Online Store—Tubes Run 100A, http://www.kswiss.com/item/201.200/02316-162/Men/Footwear_Running/Tubes_Run_100_A/Wht_Blk_Sunorng.html (visited on Oct. 2, 2009), 2 pages.

Adidas Q2 2007 Footwear Catalog, p. 5, showing the T 7 ATS shoe, and p. 122, showing the J S3 W shoe.

U.S. Appl. No. 29/405,483, Erica Callahan, "Portion of a Shoe", filed Nov. 2, 2011.

U.S. Appl. No. 29/405,484, Erica Callahan, "Portion of a Shoe", filed Nov. 2, 2011.

U.S. Appl. No. 29/408,163, Ricardo Vestuti, "Shoe and Portion of a Shoe", filed Dec. 7, 2011.

Office Action dated Aug. 12, 2011 from U.S. Appl. No. 29/362,605, Vestuti et al., Shoe and Portion of Shoe, filed May 27, 2010.

Office Action dated Sep. 13, 2011 from U.S. Appl. No. 29/345,964, Pope, Portion of a Shoe, filed Oct. 23, 2009.

U.S. Appl. No. 29/443,384, Callahan, "Shoe Sole", filed Jan. 16, 2013.

Office Action dated May 30, 2013 from U.S. Appl. No. 12/506,957, Callahan et al., Article of Footwear Having an Undulating Sole, filed Jul. 21, 2009.

(56) References Cited

OTHER PUBLICATIONS

Office Action dated May 29, 2013 from U.S. Appl. No. 12/832,464, Callahan et al., Article of Footwear and Methods of Making Same, filed Jul. 8, 2010.
Partial European Search Report for Application No. EP 10170301.5, European Patent Office, Munich, Germany, dated Sep. 29, 2014, 7 pages.
K-Swiss, Inc. Online Store—Tubes Run 100A, http://www.kswiss.com/item/201.200/0231-162/Men/Footwear_Running/Tubes_Run_100_A/Wht_Blk_Sunorng.html (visited on Oct. 2, 2009), 2 pages.
adidas Q2 2007 Footwear Catalog, page 5, showing the T 7 ATS shoe, and page 122, showing the J S3 W shoe. Year 2007.
U.S. Appl. No. 12/506,957, Erica Callahan, "Article of Footwear Having an Undulating Sole", filed Jul. 21, 2009.
U.S. Appl. No. 12/832,464, Erica Callahan, "Article of Footwear and Methods of Making Same", filed Jul. 8, 2010.
U.S. Appl. No. 29/342,098, Erica Callahan, "Shoe Sole and Portion of a Shoe Sole", filed Aug. 8, 2009.
U.S. Appl. No. 29/345,964, Christopher S. Pope, "Shoe Sole and Portion of a Shoe", filed Oct. 23, 2009.
U.S. Appl. No. 29/353,673, Erica Callahan, "Portion of a Shoe Sole", filed Jan. 12, 2010.
U.S. Appl. No. 29/362,605, Ricardo Vestuti, "Shoe and Portion of a Shoe", filed May 27, 2010.
U.S. Appl. No. 29/375,659, Toby Birkinhead, "Portion of a Shoe", filed Sep. 24, 2010.
Partial European Search Report, European Patent Office, Munich, Germany, mailing date of Feb. 6, 2015, 13 pages.

* cited by examiner

ARTICLE OF FOOTWEAR WITH SUPPORT ELEMENT

BACKGROUND OF THE INVENTION

1. Field of the Invention

The present invention is directed to an article of footwear having an undulating sole.

2. Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

BRIEF SUMMARY OF THE INVENTION

In one embodiment, an article of footwear includes an undulating foam sole, having a plurality of spaced apart peaks and a plurality of spaced apart troughs. At least one pair of adjacent peaks define a first gap substantially devoid of material between adjacent peaks, and at least one pair of adjacent troughs define a second gap substantially devoid of material between adjacent troughs. The article of footwear may further include a support element coupled to the sole. The support element may be disposed in the first gap or the second gap.

In another embodiment, an article of footwear comprises: an upper; a plate connected to the upper; an undulating sole having a top side connected to the plate and a bottom side, the sole comprising a plurality of spaced apart peaks defining a plurality of gaps in the top side and a plurality of spaced apart troughs defining a plurality of gaps in the bottom side; and a support element disposed between the sole and the plate.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 6:
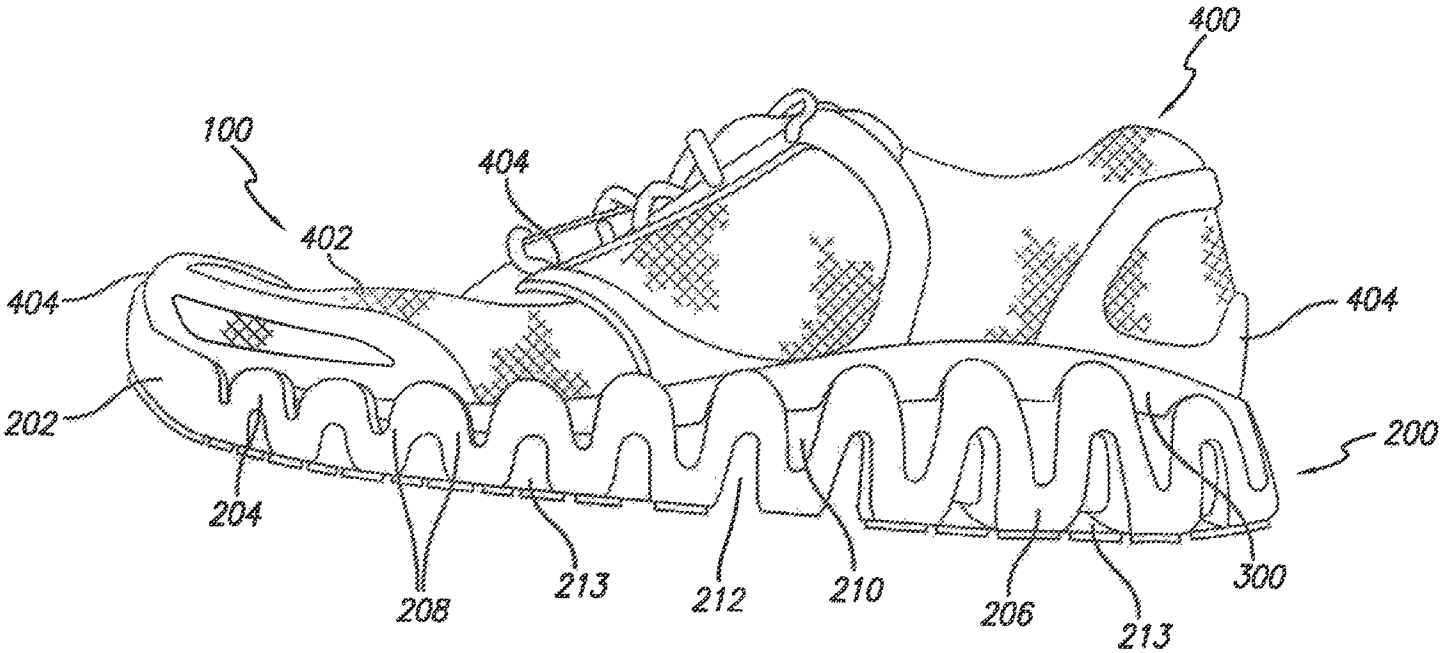
FIG. 6 is a side view of another exemplary article of footwear according to an embodiment of the present invention.
Figure 7:
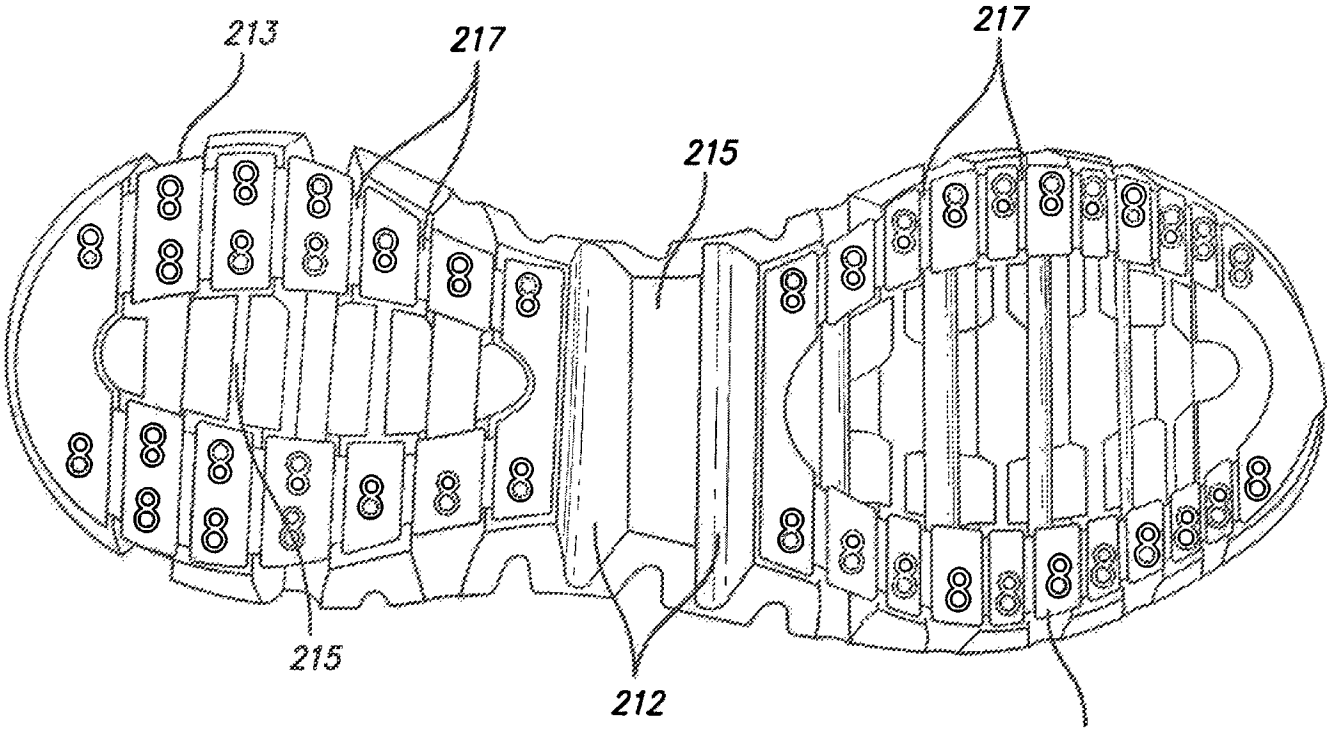
Figure 8:
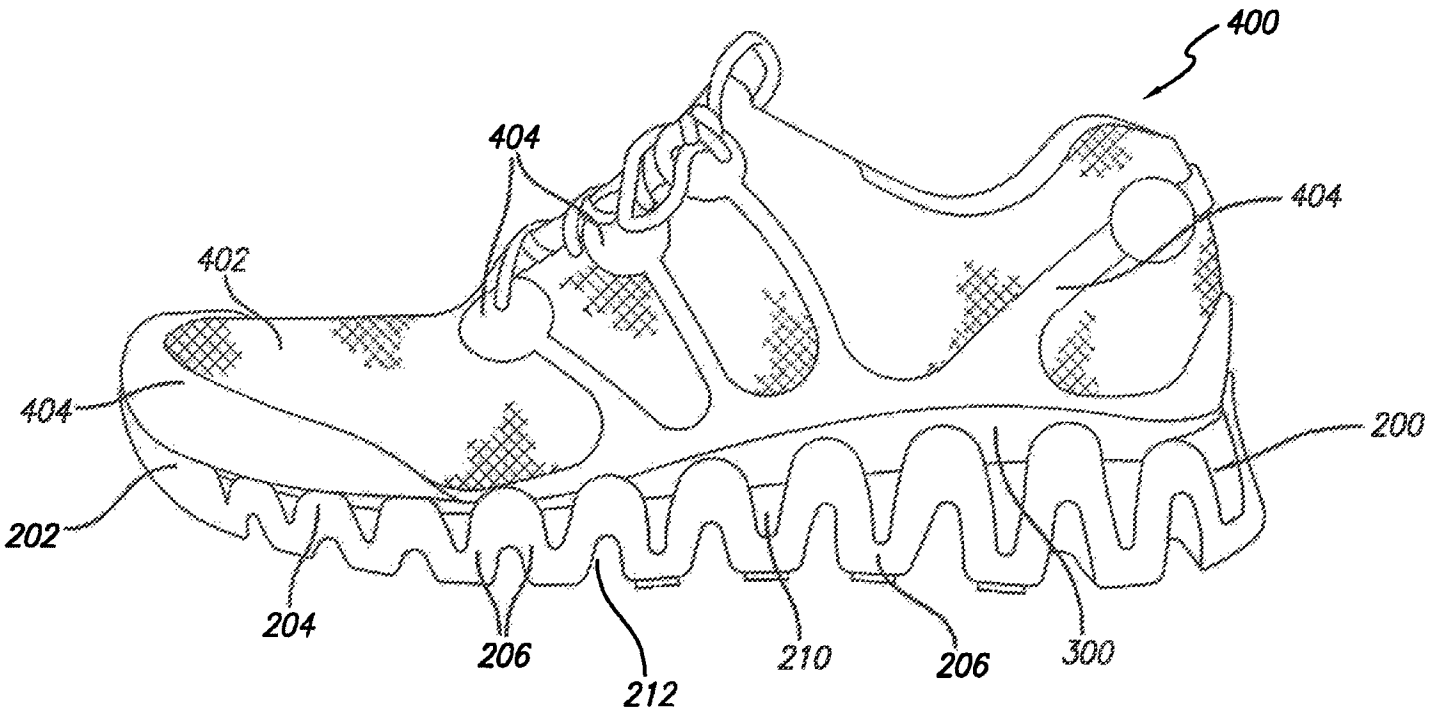
Figure 9:
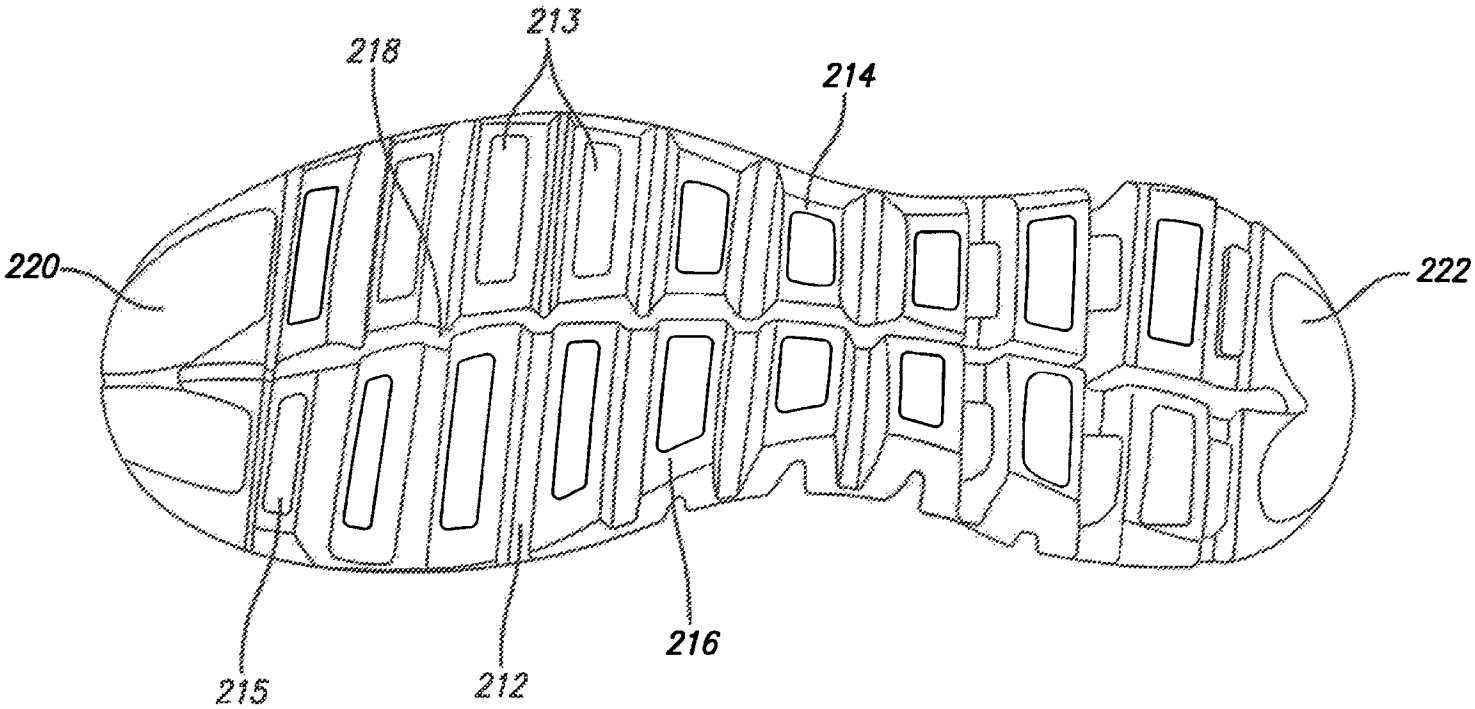
Figure 10:
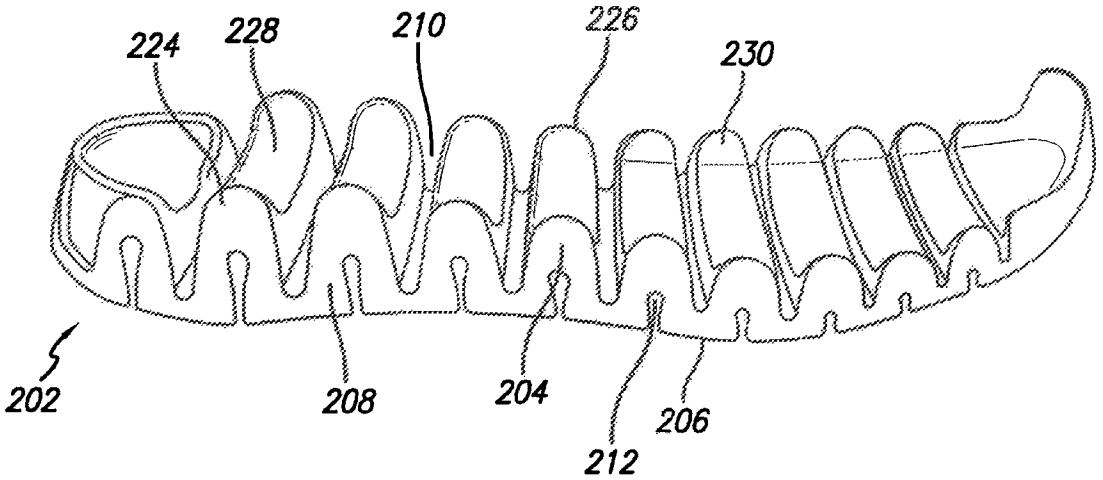
Figure 11:
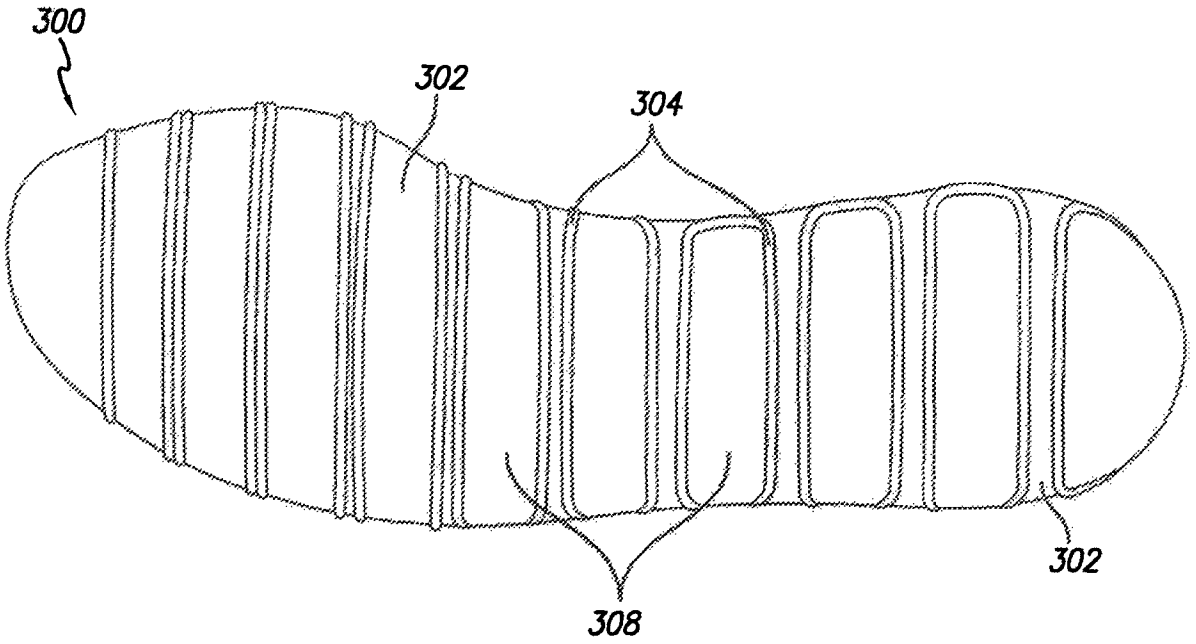
Figure 12:
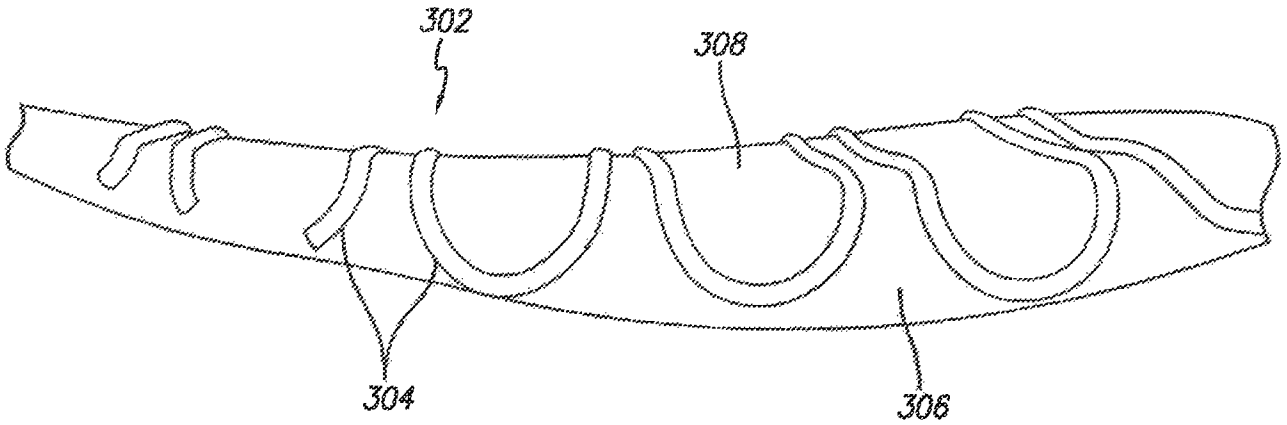

FIG. 7 a bottom view of the exemplary article of footwear of FIG. 6 according to an embodiment of the present invention;

FIG. 8 is a side view of another exemplary article of footwear according to an embodiment of the present invention;

FIG. 9 is a bottom view of the exemplary article of footwear of FIG. 8 according to an embodiment of the present invention;

FIG. 10 is a side view of an exemplary midsole according to an embodiment of the present invention;

FIG. 11 is a bottom view of an exemplary foot plate according to an embodiment of the present invention; and FIG. 12 is a partial side view of the exemplary foot plate of FIG. 11 according to an embodiment of the present invention.

Figure 13:
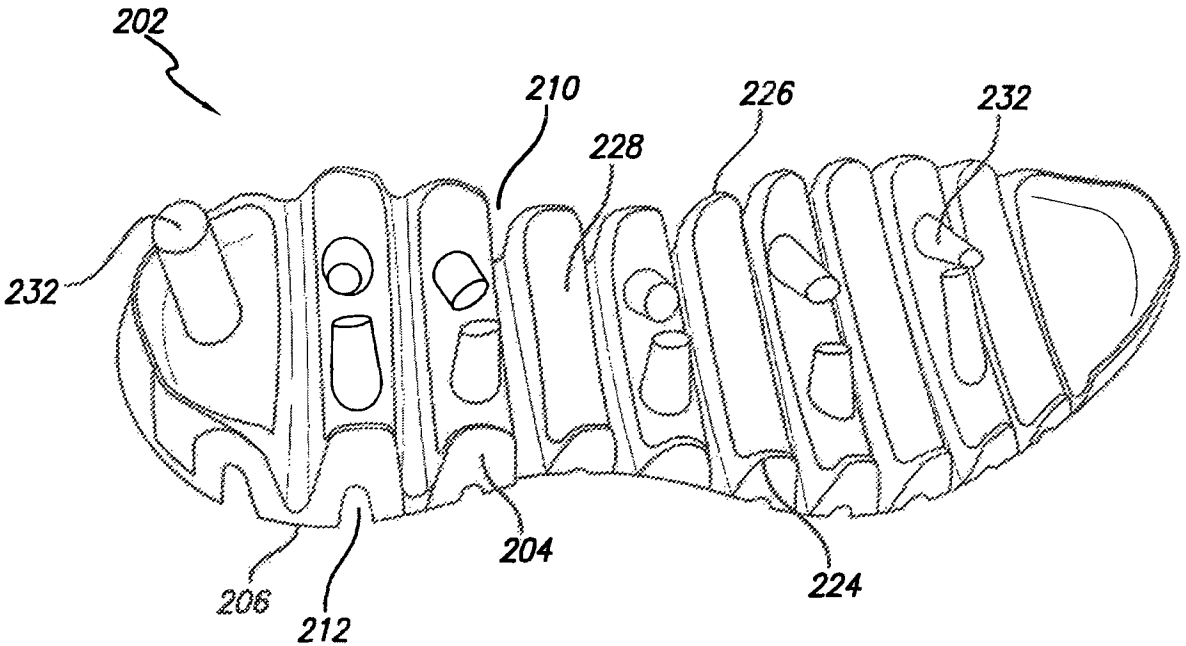

FIG. 13 is a schematic view of an exemplary article of footwear during manufacturing according to an embodiment of the present invention.

Figure 14:
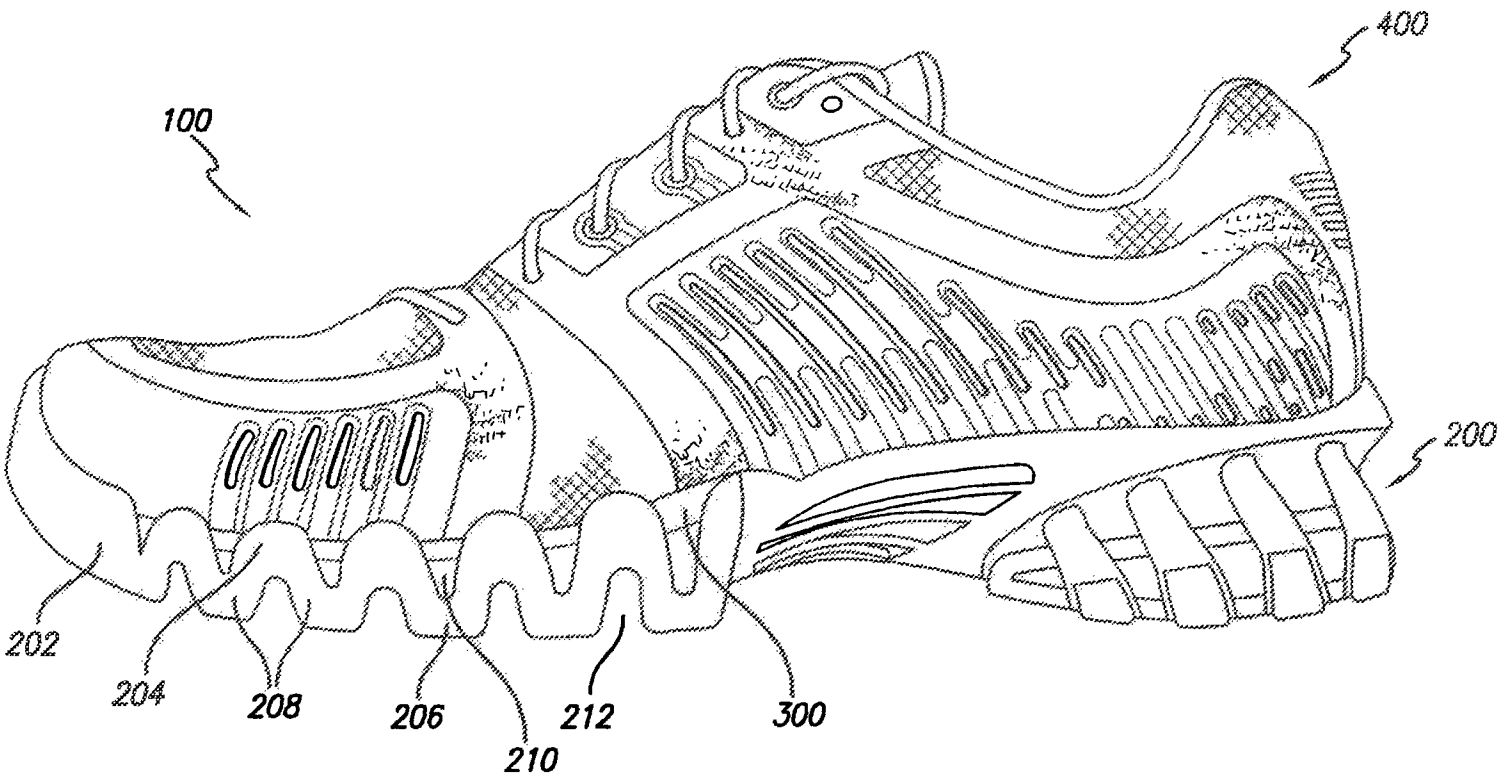

FIG. 14 is a side view of an exemplary article of footwear according to an embodiment of the present invention.

Figure 15:
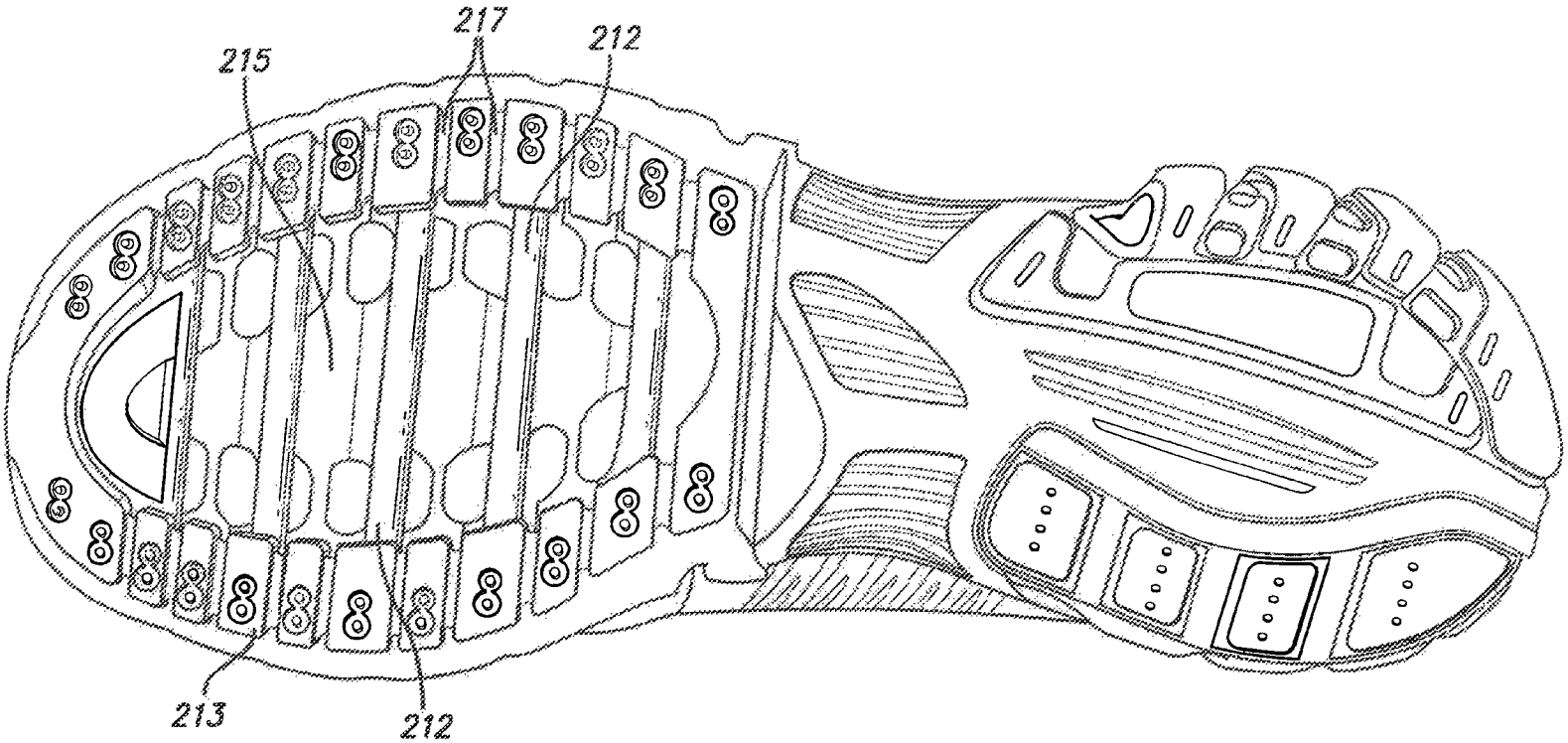

FIG. 15 is a bottom view of the exemplary article of footwear of FIG. 14 according to an embodiment of the present invention.

Figure 16:
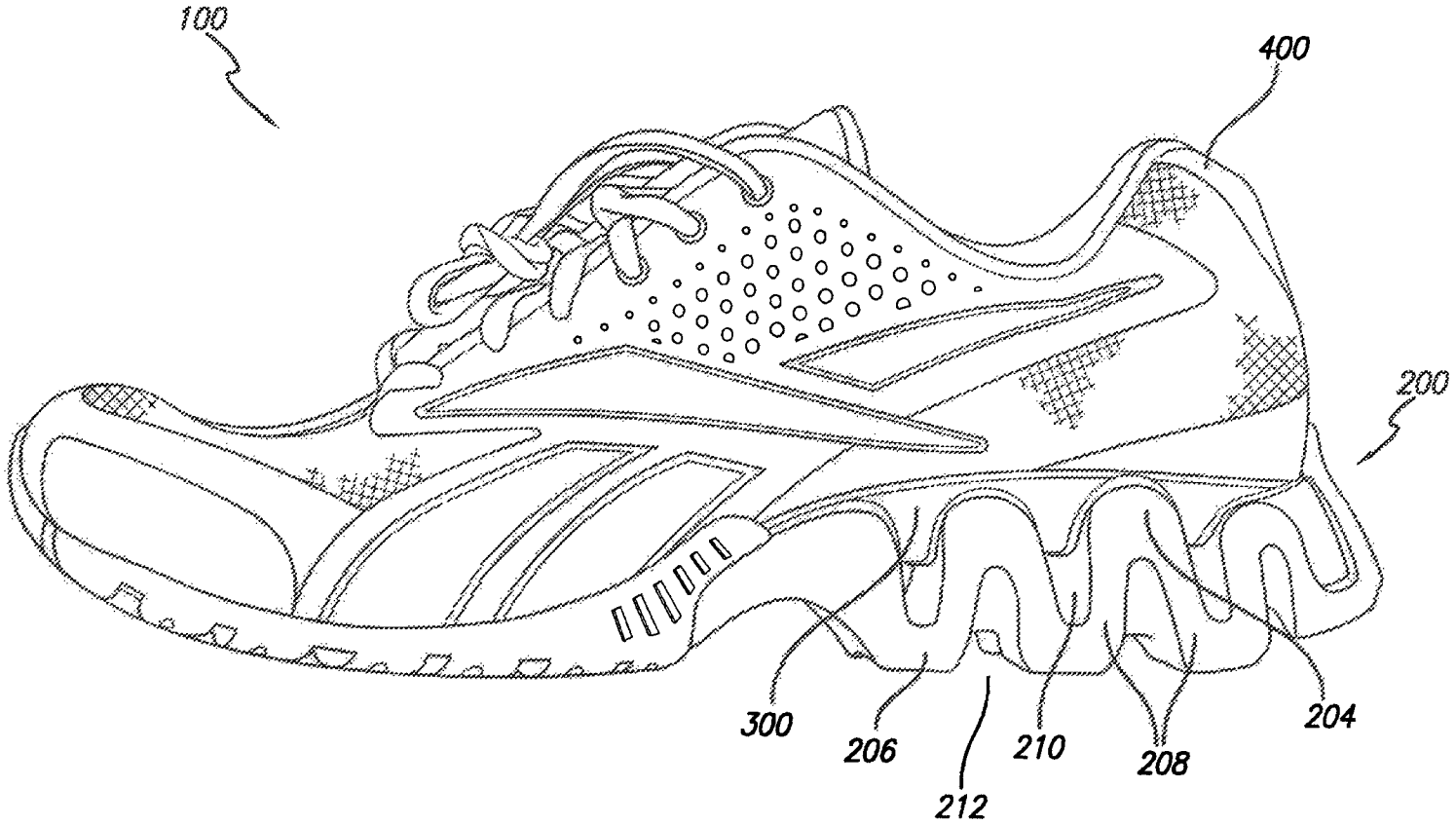

FIG. 16 is a side view of an exemplary article of footwear according to an embodiment of the present invention.

Figure 17:
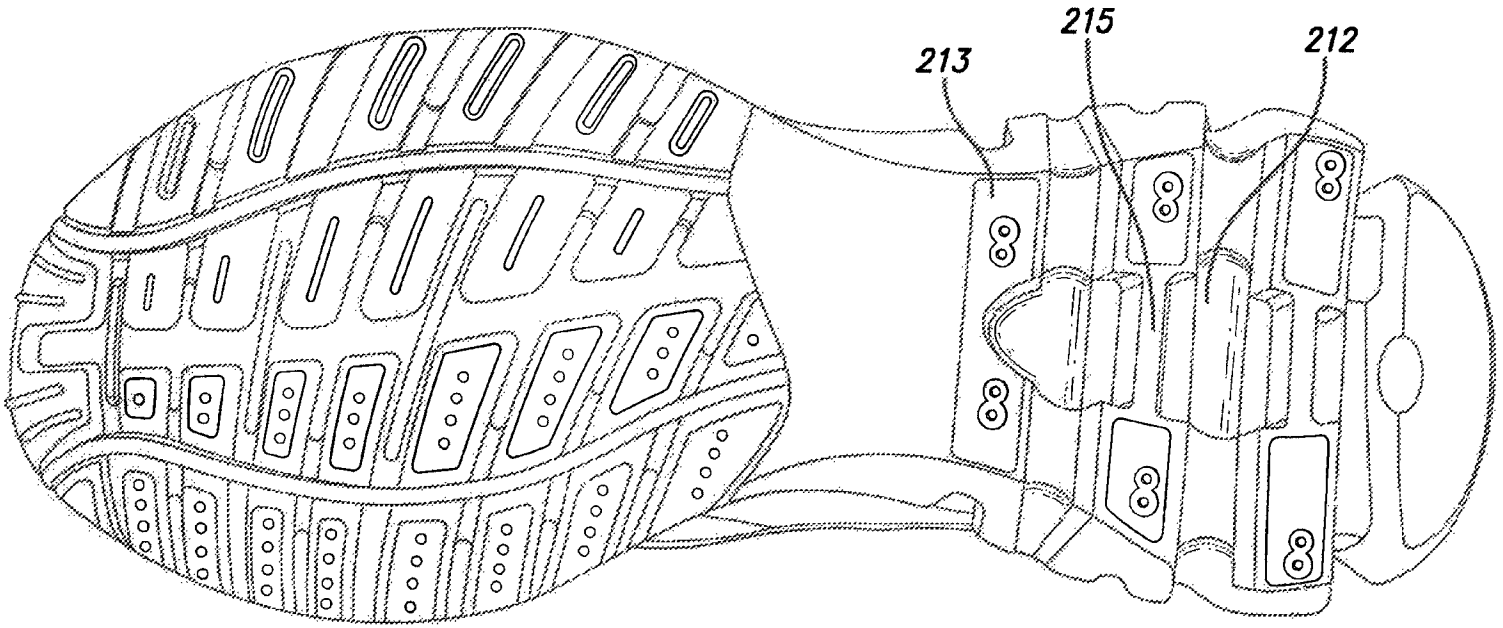

FIG. 17 is a bottom view of the exemplary article of footwear of FIG. 16 according to an embodiment of the present invention.

Figure 18:
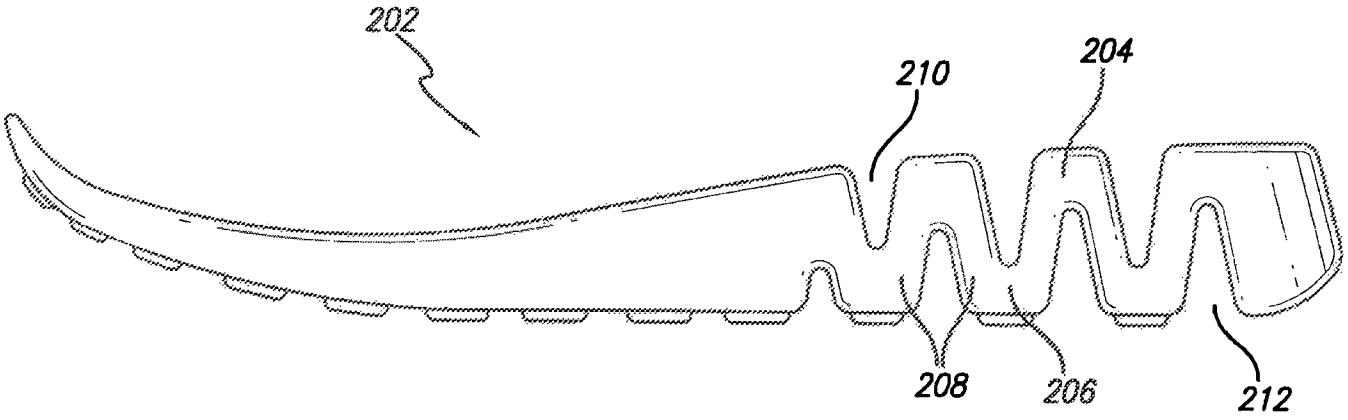

FIG. 18 is a side view of an exemplary midsole for use in the exemplary article of footwear of FIG. 16 according to an embodiment of the present invention.

Figure 19:
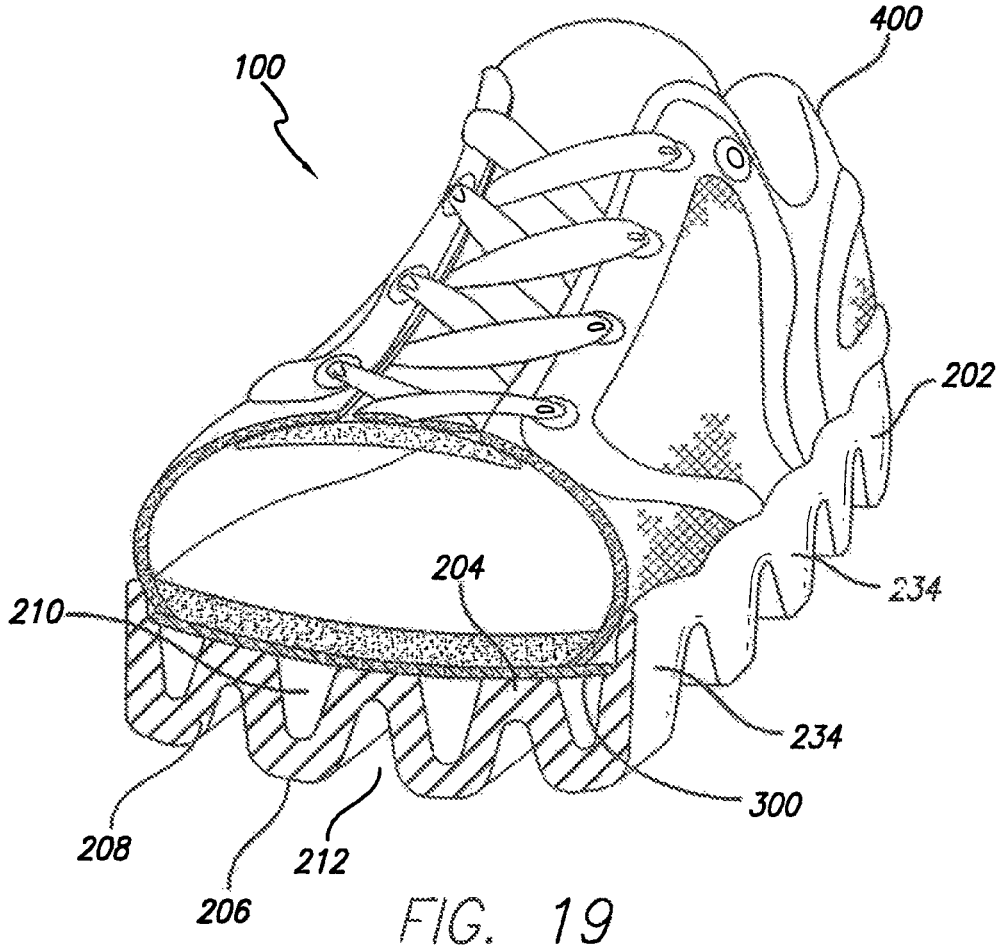

FIG. 19 is front perspective cross-sectional view of an exemplary article of footwear according to an embodiment of the present invention.

Figure 20:
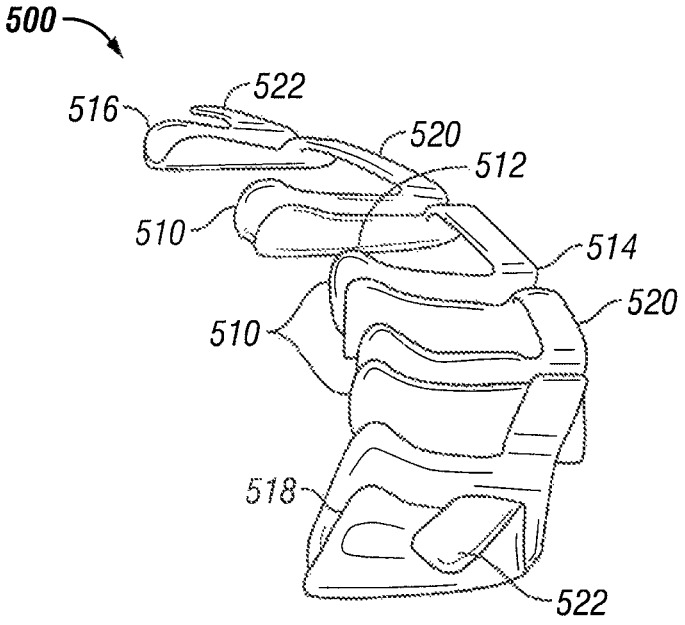

FIG. 20 is a top perspective view of an insert according to an embodiment of the present invention.

Figure 21:
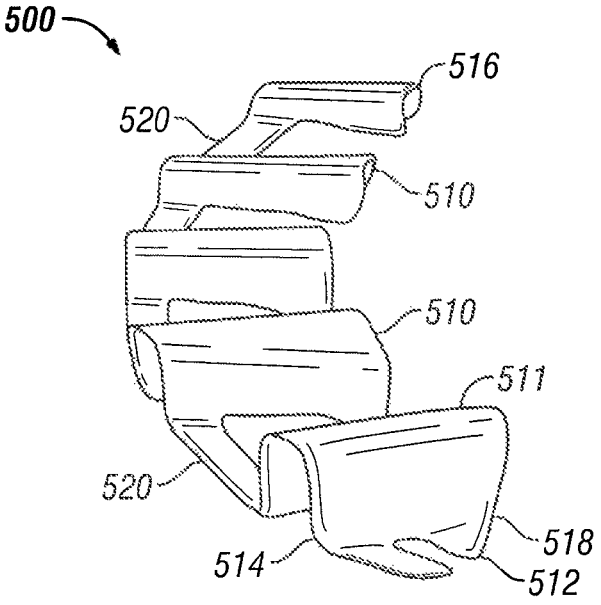

FIG. 21 is a bottom perspective view of the insert shown in FIG. 20 according to an embodiment of the present invention.

Figure 22:
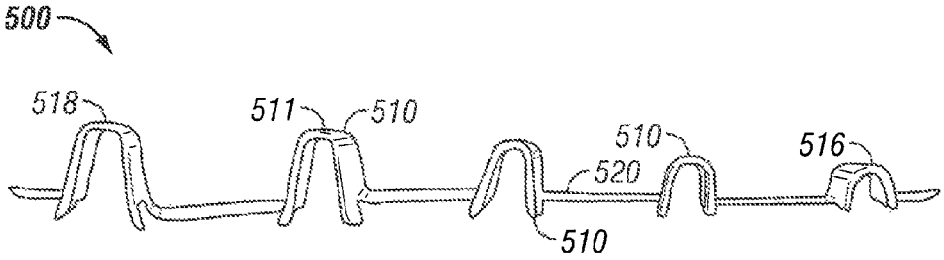

FIG. 22 is a side view of the insert shown in FIG. 20 according to an embodiment of the present invention.

Figure 23:
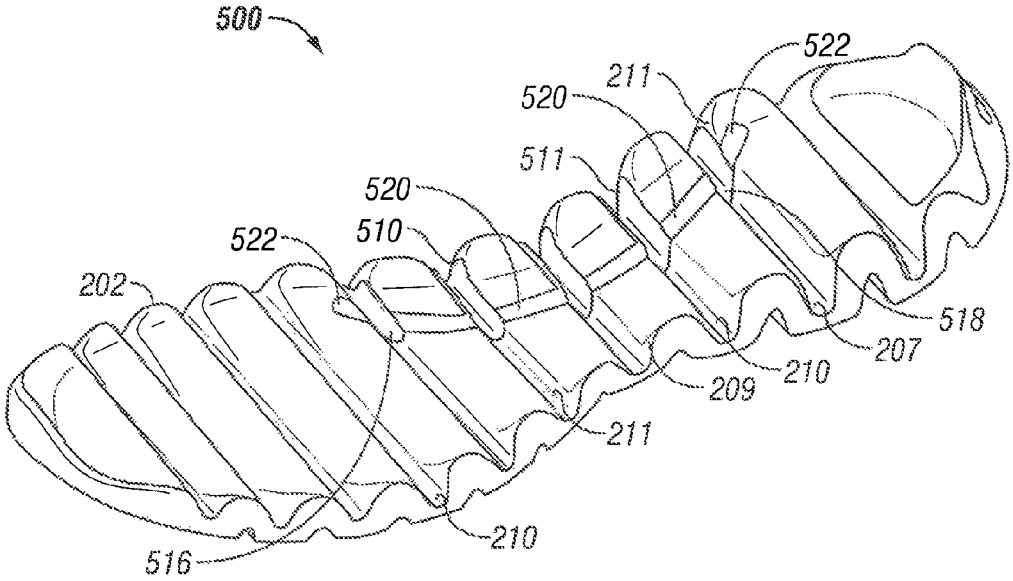

FIG. 23 is a top perspective view of a midsole with an insert according to an embodiment of the present invention.

Figure 24:
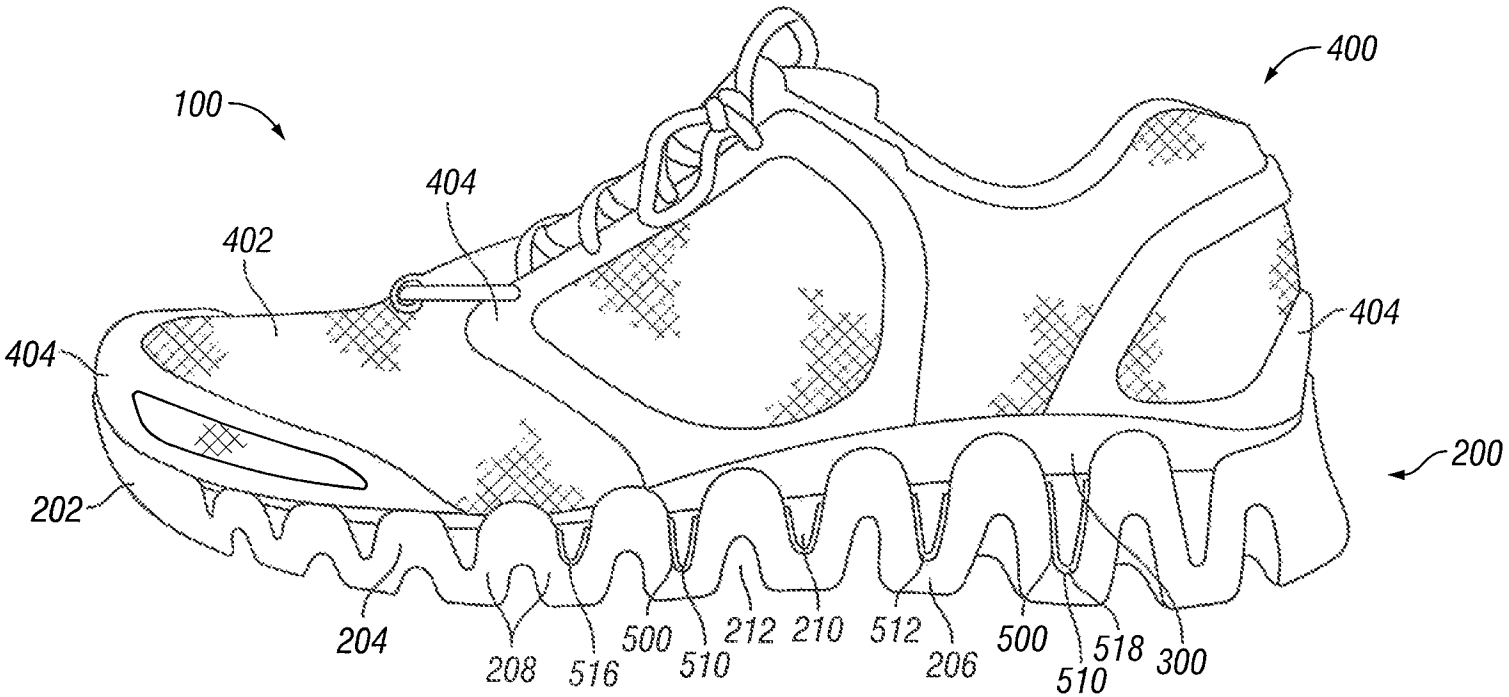

FIG. 24 is a side view of an article of footwear with an insert according to an embodiment of the present invention.

Figure 25:
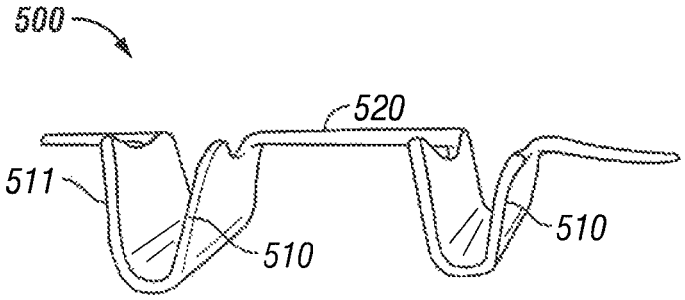

FIG. 25 is a side view of an insert according to an embodiment of the present invention.

Figure 26:
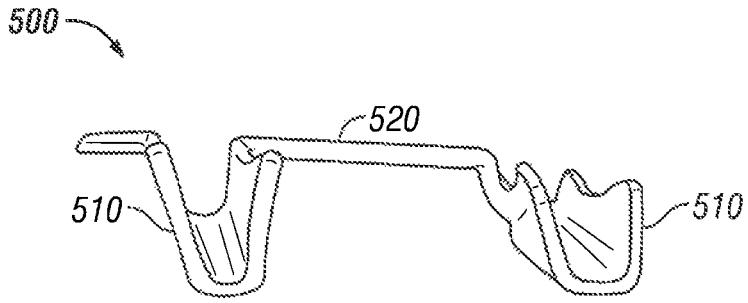

FIG. 26 is a side view of an insert according to another embodiment of the present invention.

Figure 27:
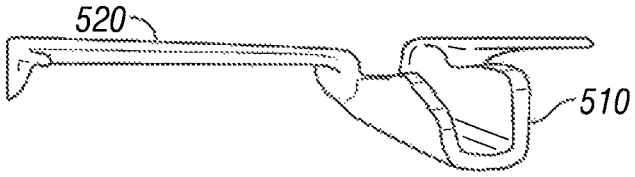

FIG. 27 is a side view of an insert according to another embodiment of the present invention.

Figure 28:
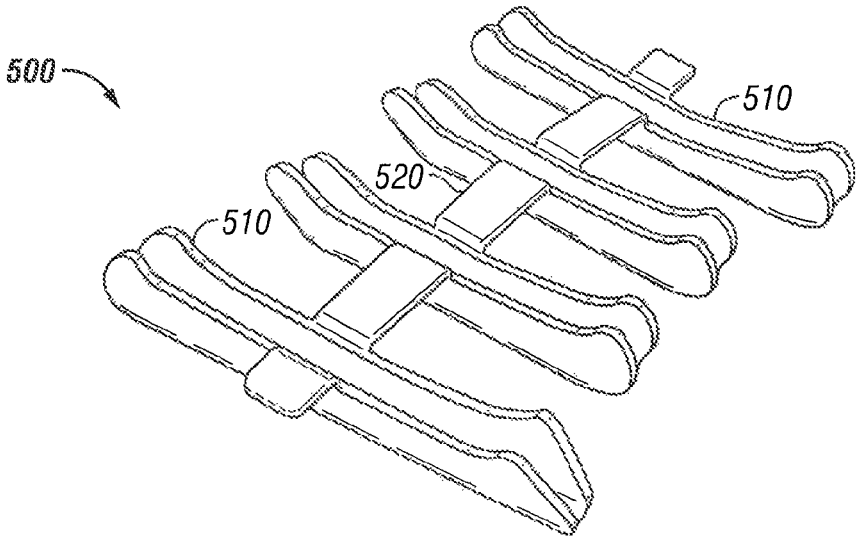

FIG. 28 is a top perspective view of an insert according to another embodiment of the present invention.

Figure 29:
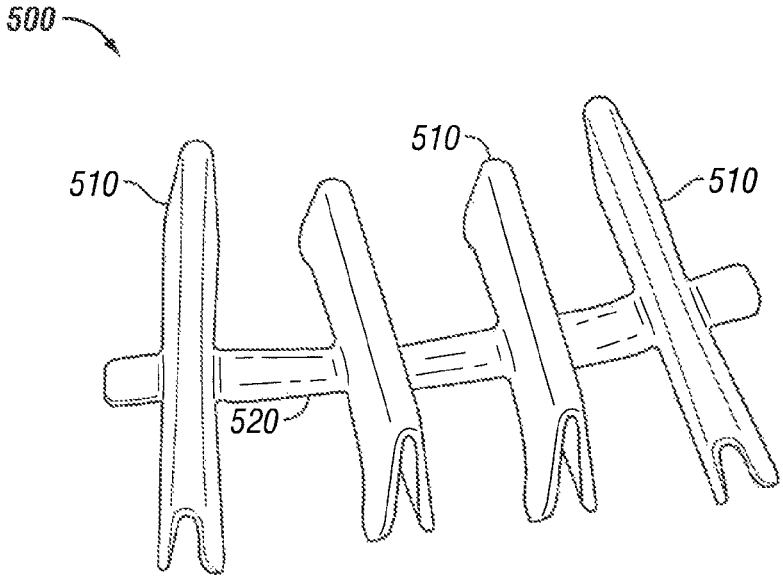

FIG. 29 is a bottom perspective view of the insert shown in FIG. 29 according to an embodiment of the present invention.

Figure 30:
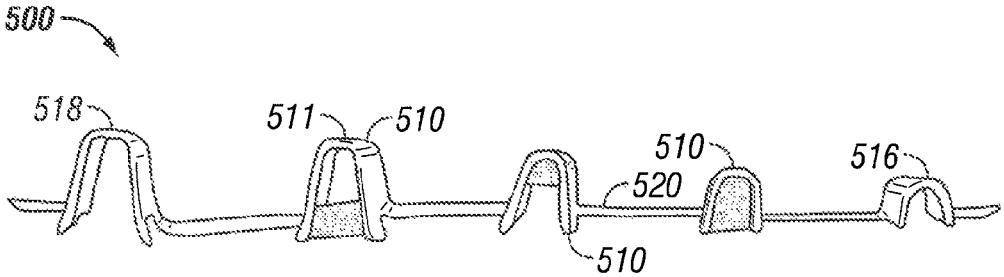

FIG. 30 is a side view of an insert having solid support elements according to an embodiment of the present invention.

DETAILED DESCRIPTION OF THE INVENTION

The present invention is now described with reference to the Figures, in which like reference numerals are used to indicate identical or functionally similar elements. While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

An article of footwear 100 according to an embodiment of the present invention may have a sole 200 that undulates to provide a different and unique ride and/or feel to article of footwear 100 while also providing a unique aesthetic appeal and providing training for the wearer's muscles in the legs, lower back, and/or abdomen. A foot plate 300 is attached to undulating sole 200 and an upper 400 is attached to foot plate 300.

Sole 200 may include a midsole 202 having an undulating shape with alternating peaks 204 and troughs 206. In some embodiments, the undulating shape of midsole 202 may be substantially sinusoidal, whereby one or more of the peaks and/or troughs may be rounded. In other embodiments, the undulating shape of midsole 202 may be zigzagged, whereby one or more of the peaks and/or troughs may be pointed. In some embodiments, peaks 204 may be located substantially equidistant between adjacent troughs 206, and similarly, troughs 206 may be located substantially equidistant between adjacent peaks. Between each peak 204 and each trough 206 may be a wall 208. Gaps 210 devoid of material may be present between adjacent peaks 204 and above a trough 206 and gaps 212 devoid of material may be present between adjacent troughs 206 and below a peak 204. Gaps 210 and gaps 212 may extend across an entire width of midsole 202. In an alternative embodiment, gaps 210 and gaps 212 may extend only along a portion of midsole 202. In one embodiment, the undulating shape of midsole 202 may be substantially similar to a sine wave. A distance between adjacent peaks 204 or adjacent troughs 206 may be substantially similar or may be varied along a length of midsole 202 or combinations thereof.

Midsole 202 may be designed such that each trough 206 contacts or engages the ground separately when a user is walking, running, or otherwise moving under his/her own power. As each trough 206 contacts or engages the ground a compressive force is exerted causing distortion of the shape of gap 210 located above trough 206 as a result of vertical buckling of walls 208 connected to trough 206. The compressive forces can also distort the shape of gaps 212 on either side of trough 206 to increase the distance between the trough 206 contacting or engaging the ground and those adjacent to it. Shear forces exerted on midsole 202 may have the same effect of buckling walls 208 and distorting the shape of gaps 210 and 212.

Accordingly, material for midsole 202 must be sufficiently flexible to allow the buckling and distortions described above so as to provide adequate cushioning. Suitable material for midsole 202 may include, but is not limited to, foam and thermoplastic polyurethane. When midsole 202 is a foam, the foam may be, for example, ethyl vinyl acetate (EVA) based or polyurethane (PU) based and the foam may be an open-cell foam or a closed-cell foam. In other embodiments, midsole 202 may be elastomers, thermoplastic elastomers (TPE), foam-like plastic (e.g., Pebax® foam or Hytrel® foam) and gel-like plastics.

Individually or in combination, the aspects of midsole 202 that uniquely absorb the compressive and shear forces may include the: (1) tall, thin shape of walls 208, (2) angles between adjacent walls 208 of undulating midsole 202, (3) gaps 210 and 212 void of material on either side of walls 208; and/or (4) compression of the foam itself (aside from distortion of the sole geometry). Buckling may occur due to tall, thin walls 208. The voids of material or gaps 210, 212 may allow for the buckling and/or distention of the material of midsole 202 to occur when loaded. The contact of midsole 202 on the ground in the midfoot region may provide a new ride to the shoe. The heel strike may take a prolonged amount of time compared to a typical running shoe, which can decrease the peak forces. When a force is applied to the midsole, not only does the midsole material compress, but the physical shape of the midsole may also change to absorb the compressive and shear forces. The physical changes in shape, and/or the buckling, which may include walls 208 distending into one of the voids of material or gaps 210, 212 on either side of the wall, may occur because of the tall, thin shape of walls 212, angles between walls 208 of the undulating midsole 202, and/or voids of material or gaps 210, 212 on either side of walls 208. The unique shape, midsole contact with the ground in the midfoot region, and/or material may vary the amount of time spent in each phase of the gait cycle for an individual compared to a more traditional running shoe, possibly decreasing the peak force experienced by that individual.

The above described effects of the compressive forces and shear forces on midsole 202 may cause the wearer's body to work harder. By forcing the wearer's body to work harder, the shoe may trigger increased training to the muscles, such as those muscles in the wearer's calves, thighs, lower back, buttocks, and/or abdomen. As a result of this extra work, when a wearer travels a given distance, the affected muscles may feel like they have worked in traversing a distance farther than the given distance, thereby enhancing a wearer's amount of exercise.

Figure 1:
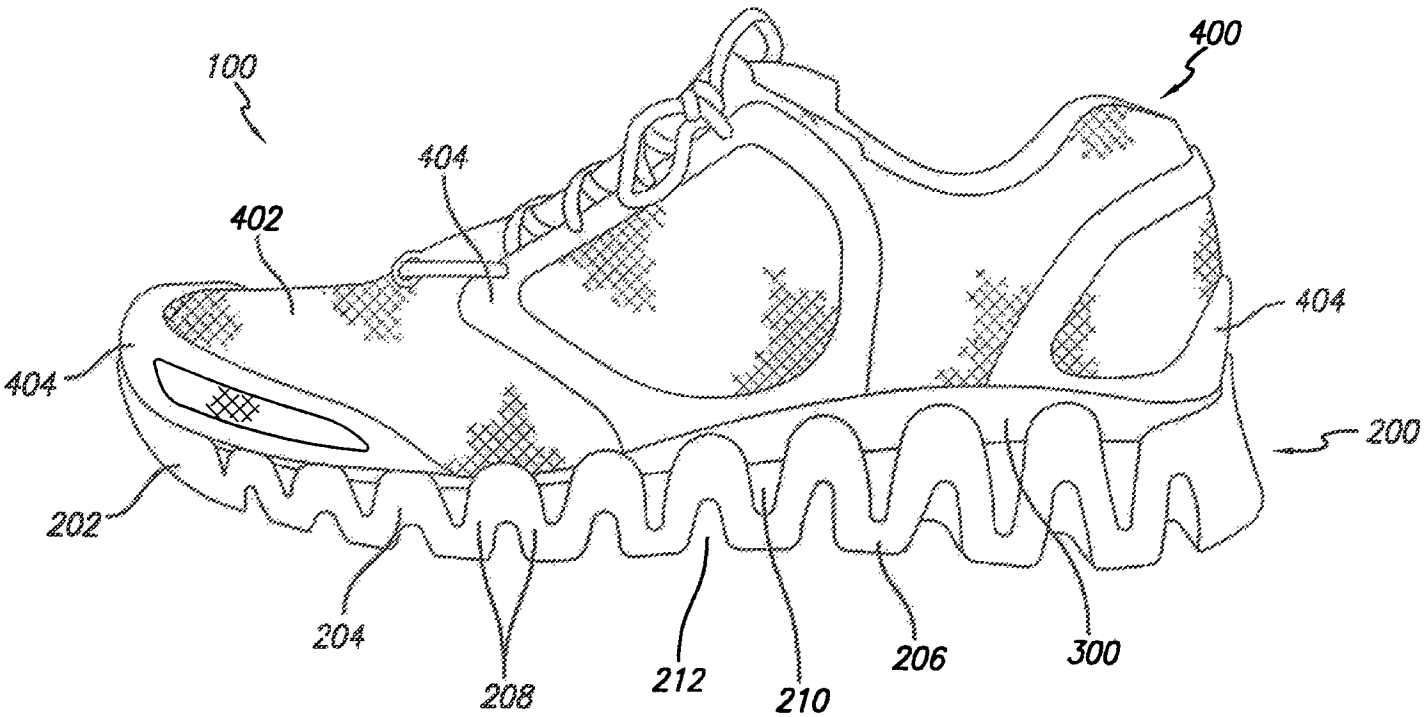
FIG. 1 is a side view of an exemplary article of footwear according to an embodiment of the present invention.

Walls 208 may be contoured to provide gaps 210 and gaps 212 with a variety of shapes in order to impart varying cushioning effects. In one embodiment, as shown for example in FIGS. 1 and 6, gaps 210 may be substantially v-shaped. The angle provided between adjacent walls 208 may be adapted to provide the desired cushioning properties. For example, in one embodiment the angle between adjacent walls 208 may be in the range of from about 10 degrees to about 50 degrees, such as from about 10 degrees to about 40 degrees or about 15 degrees to about 35 degrees. In one embodiment, the angle between adjacent walls may vary along the length of midsole 202. For example, in one embodiment the angle may be greater between one or more pair of adjacent walls 208 in the heel portion of midsole 202 and lesser between one or more pair of adjacent walls 208 in the forefoot portion. For example, in some embodiments the angle between adjacent walls 208 in the forefoot portion may be from about 30 to about 40 degrees. In some embodiments the angle between adjacent walls 208 in the heel portion may be from about 15 to about 25 degrees. In another embodiment, as also shown for example in FIG. 1, gaps 212 may be substantially shaped as an inverted v.

The depth of gaps 210 and 212 may also be varied to provide the desired cushioning properties. In one embodiment, as shown for example in FIG. 1, the depth of gaps 210 may vary along the length of midsole 202. For example, gaps 210 may be deeper in the heel region of midsole 202, and become more shallow toward the forefoot region of midsole 202.

Figure 3:
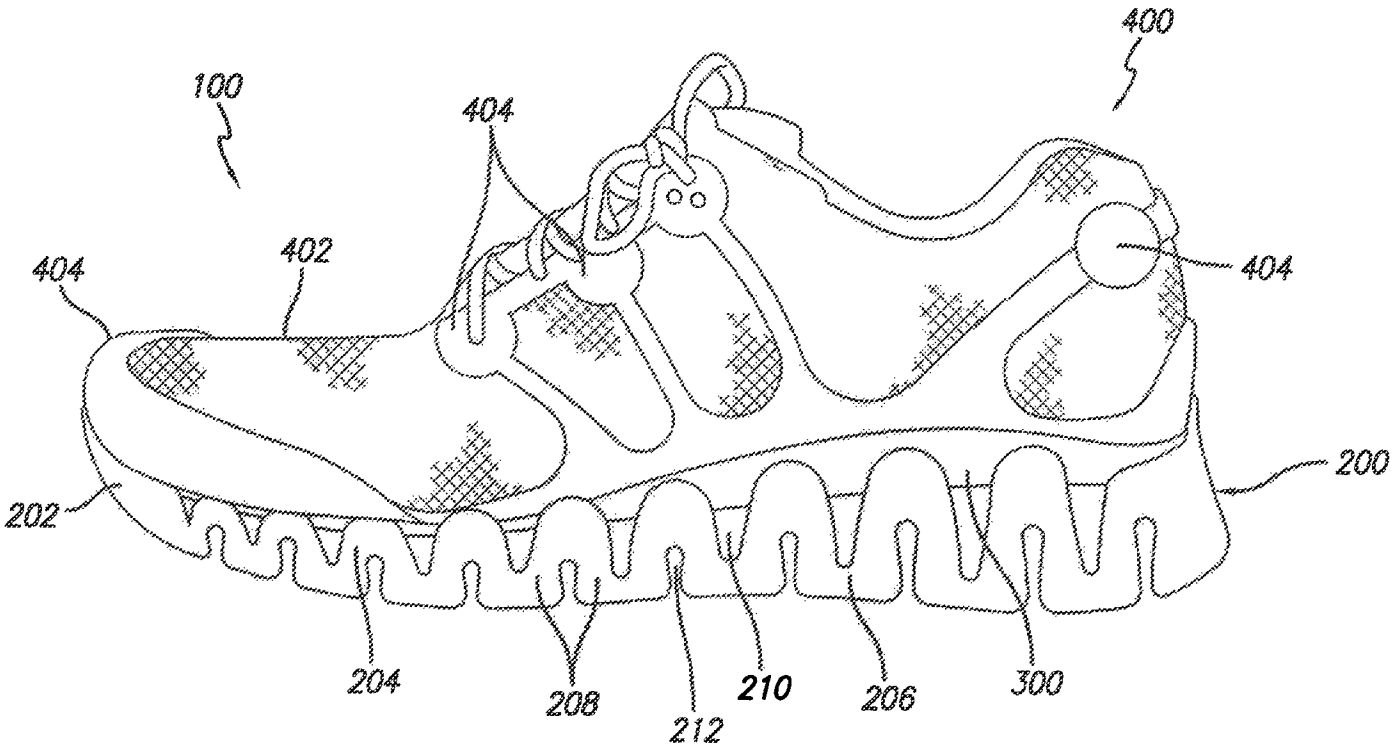
FIG. 3 is a side view of another exemplary article of footwear according to an embodiment of the present invention.
Figure 5:
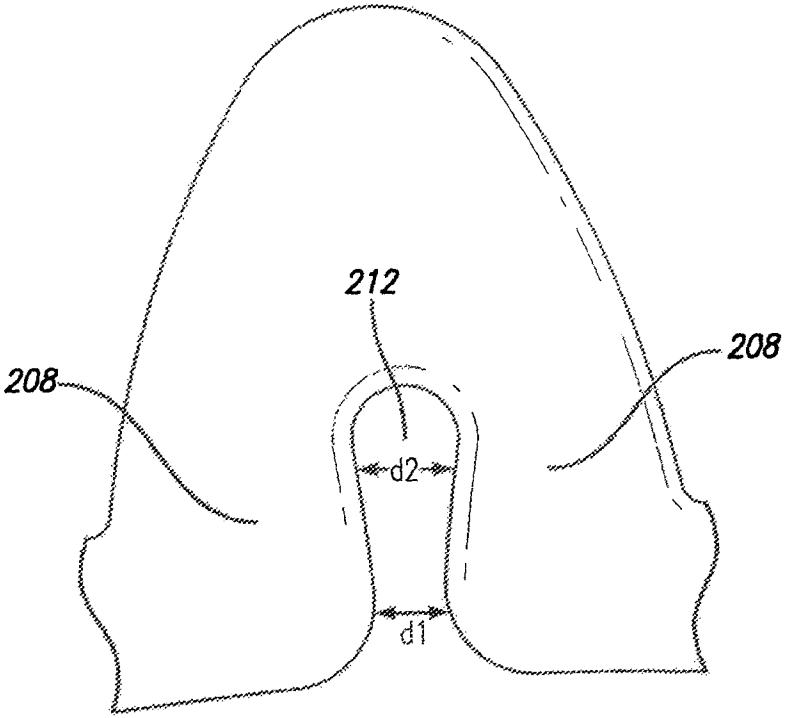
FIG. 5 is a close up side view of a portion of a midsole of the exemplary article of footwear of FIG. 3 according to an embodiment of the present invention.

In another embodiment, as shown for example in FIGS. 3 and 5, gaps 212 may be substantially omega-shaped (Q) such that each gap 212 has a rounded top section and a narrow bottom section wherein the distance d1 between the surface of the two walls 208 forming and facing each gap 212 is shorter at the bottom of gap 212 than a distance d2 in a middle portion of gap 212. The embodiments described above are merely exemplary and gaps 210 and gaps 212 may have any combination of shapes as would be apparent to one of ordinary skill in the art. For example, in one embodiment midsole 202 may include a combination of v-shaped and omega-shaped gaps.

The number of walls 208, and, correspondingly, the number of gaps 210 and 212 provided in midsole 202 may vary depending upon the desired cushioning characteristics or upon the length and width of midsole 202. In one embodiment, as shown for example in FIG. 1, midsole 202 may include ten gaps 210. The number of gaps 210 and 212 may vary depending upon a thickness of walls 208, a frequency of the undulation, and/or the angle between adjacent walls 208.

One or more troughs 206 of midsole 202 may have an outsole piece 213 attached thereto to provide additional traction. Outsole piece 213 may be rubber or any suitable material typically utilized for an outsole. In one embodiment, as shown for example in FIG. 2, a trough 206 may have one or more outsole pieces 213. In another embodiment, as shown for example in FIG. 4, outsole piece 213 may contact one or more troughs 206 and span a portion of gap 212 between adjacent troughs 206. In another embodiment, as shown for example in FIG. 7, midsole 202 may have an outsole piece 213 that covers a periphery of a heel region of midsole 202 and/or another outsole piece 213 that covers a periphery of a forefoot region of midsole 202. Outsole piece 213 spans gaps 212 between adjacent troughs 206 and may include areas of reduced thickness 217 that allow outsole piece 213 to flex and lengthen when gaps 212 lengthen. Outsole pieces 213 may be made from a suitable polymeric material that permits the above-described lengthening and flexing. The above embodiments are merely exemplary and one skilled in the art would readily appreciate the pattern of outsole piece(s) 213 on trough(s) 206 of midsole 202 may have a variety of configurations. In addition, as shown in FIGS. 2, 4, 7, and 9, a bottom surface 215 of each trough 206 may have a contour that varies across a width of midsole 202. Bottom surface 215 of each trough 206 may have the same contour and/or shape, varying contours and/or shapes and combinations thereof. One skilled in the art would readily appreciate that the shape and pattern of outsole piece(s) 213 may correspond to the contour or shape of bottom surfaces 215 of troughs 206.

Figure 2:
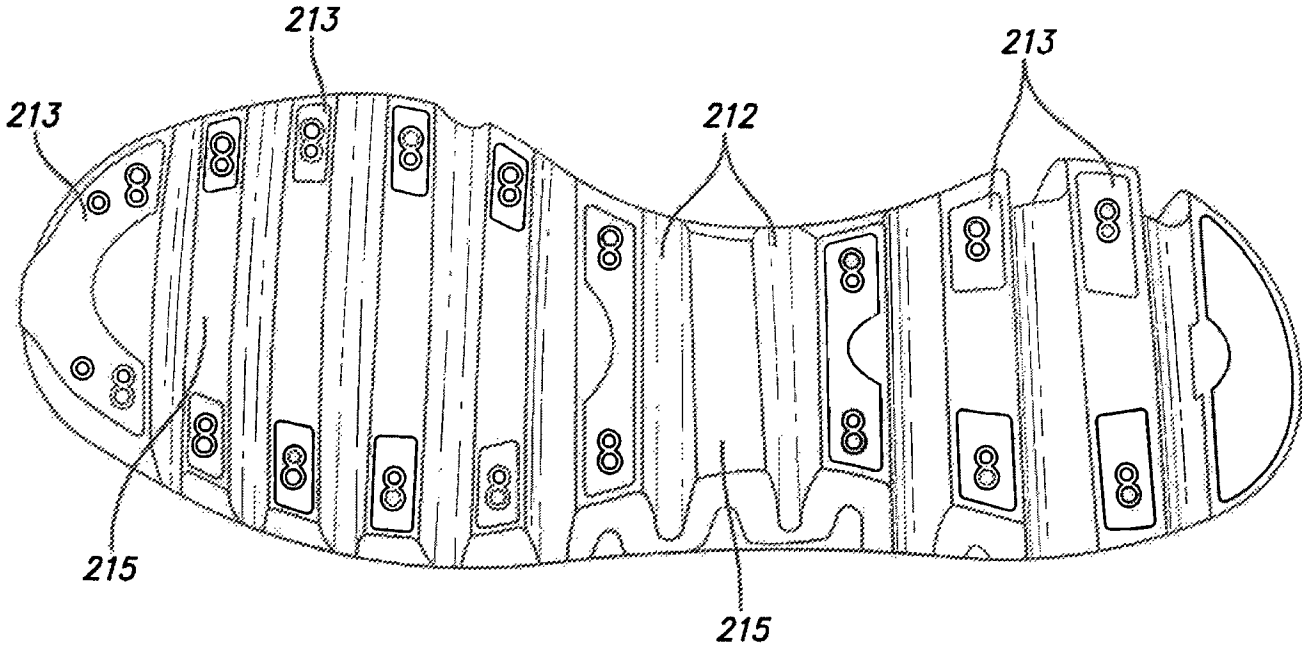
FIG. 2 is bottom view of the exemplary article of footwear of FIG. 1 according to an embodiment of the present invention.
Figure 4:
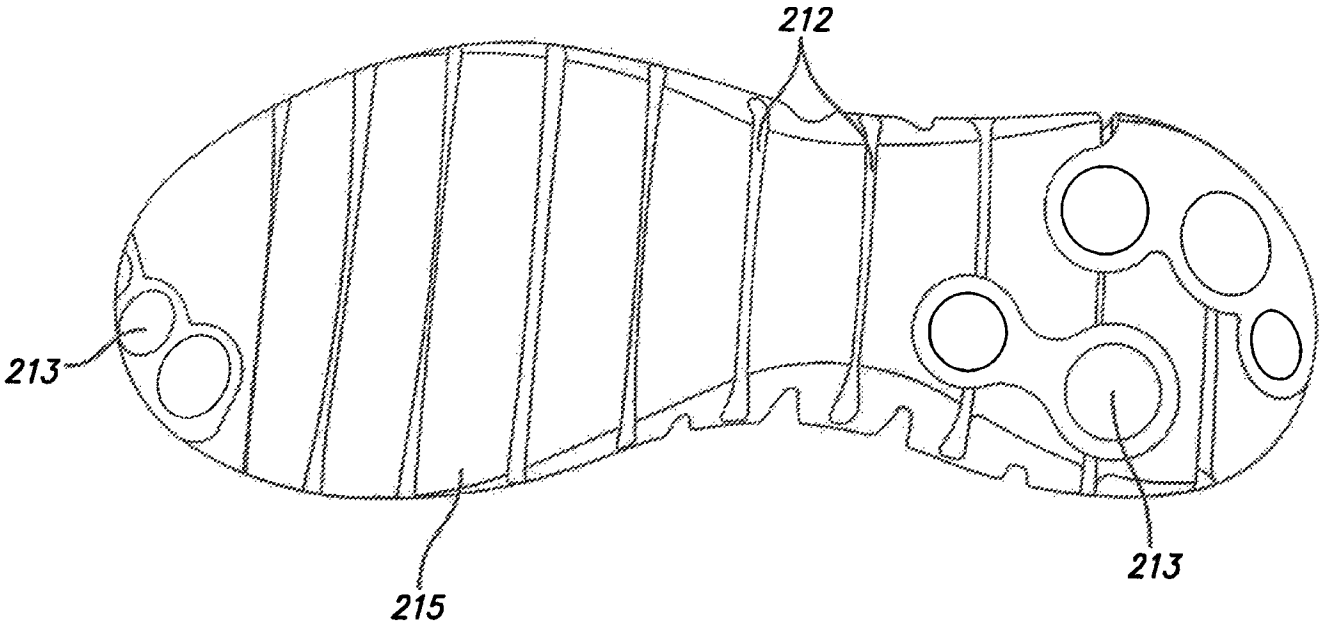
FIG. 4 is a bottom view of the exemplary article of footwear of FIG. 3 according to an embodiment of the present invention.

Midsole 202 may be a single piece, as shown for example in FIGS. 2 and 4, or may comprise two or more pieces. In one embodiment, as shown for example in FIG. 9, midsole 202 may have a lateral midsole piece 214 extending along a lateral side of article of footwear 100 and a medial midsole piece 216 extending along a medial side of article of footwear 100 with a space 218 located between lateral midsole piece 214 and medial midsole piece 216. A forefoot outsole piece 220 may be attached to both lateral midsole piece 214 and medial midsole piece 216 in a manner such that forefoot outsole piece 220 spans and covers a portion of space 218 at the forefoot of article of footwear 100. Similarly, a heel outsole piece 222 may be attached to both lateral midsole piece 214 and medial midsole piece 216 in a manner such that heel outsole piece 222 spans and covers a portion of space 218 at the heel of article of footwear 100. Lateral midsole piece 214 and medial midsole piece 216 may have corresponding undulations such that peaks 204 and troughs 206 of each piece are aligned when assembled in article of footwear 100. Having a separate lateral midsole piece 214 and medial midsole piece 216 may have the advantage of providing a ride or cushioning different from a single piece midsole 202.

As best seen in FIG. 10, midsole 202 may be shaped so that peaks 204 have a greater height at first and second sides 224, 226 of midsole 202 than in an area between first and second sides 224, 226. For example, a top surface 228 of each peak 204 is substantially concave, thereby providing a recess for receiving foot plate 300. In one embodiment, top surface 228 of some peaks 204 may have a groove 230 adjacent first and/or second sides 224, 226 that aids in aligning foot plate 300 in the recess and holding foot plate 300 in place.

Foot plate 300, as best seen in FIGS. 11 and 12, may have a bottom surface 302 with a plurality of ridges 304 extending outward from bottom surface 302. Ridges 304 may be shaped to provide outlines that correspond to the size, shape, and contour of top surfaces 228 of peaks 204 of midsole 202. Ridges 304 may also extend to side surfaces 306 of foot plate 300. Accordingly, ridges 304 aid in aligning foot plate 300 on top surfaces 228 of peaks 204 of midsole 202.

Foot plate 300 may be any suitable thermoplastic material or composite material and, in some embodiments, may be manufactured through molding or lay-up. In other embodiments, foot plate 300 may be a molded foam, such as a compression molded foam, TPU, or Pebax®. In one embodiment, foot plate 300 may be formed separately from midsole 202 and then attached and joined to midsole 202 through adhesive bonding, welding, or other suitable techniques as would be apparent to one of ordinary skill in the art. Areas 308 of bottom surface 302 that contact top surfaces 228 of peaks 204 may be textured to facilitate attachment of foot plate 300 to midsole 202. In another embodiment, foot plate 300 and midsole 202 may be co-molded and thereby formed together simultaneously.

Midsole 202 may be used in conjunction with a variety of uppers 400. In one embodiment, upper 400 may have a bootie 402 for receiving the foot of a wearer attached to an upper surface (not shown) of foot plate 300. In some embodiments, plate 300 may be placed inside shoe 100 and midsole 202 may be attached directly to upper 400. Bootie 402 may be any suitable material that is lightweight and breathable known to those of ordinary skill in the art for use as an upper. Bootie 402 may be attached to the foot plate through adhesive or other conventional attachment techniques. Upper 400 may also have one or more structural members 404 extending from foot plate 300. Structural members 404 provide structure to bootie 402 and may extend along the lateral and medial sides and be utilized in lacing article of footwear 100. Structural members 404 may also be present at a heel area to provide an internal or external heel counter or at a forefoot area to provide an internal or external toe cap. Structural members 404 may be molded from suitable polymeric materials known to those of ordinary skill in the art. Structural members 404 may also have a variety of shapes and sizes as would be apparent to one of ordinary skill in the art.

As will be apparent to those of ordinary skill in the art, midsole 202 may be molded using one or more molds. With reference to FIG. 13, during molding one or more sprue passages may be used to introduce midsole material into the mold. As shown in FIG. 13, in one embodiment of the present invention, eleven (11) sprues may be used to introduce material into the mold, thereby resulting in posts 232, which will be subsequently removed, extending from midsole 202 in the areas corresponding to the sprues. In this manner, the material may be distributed evenly throughout the midsole. In the heel portion of midsole 202, one sprue may be used in the area of the rearmost peak, and two sprues may be used at each of the next two peaks in the heel region. Two sprues may also be used at each of the fifth, seventh, and ninth peaks in midsole 202. In another embodiment, one or more sprues may be used at each of the peaks to introduce the midsole material to the mold. The use of sprues for introducing midsole material into the mold may be useful because sprues may provide for even flow of material; may help to provide proper curing of material; may help to provide even temperature distribution after filling which, in turn, may contribute to consistent skin thickness; may help to make midsoles that are consistent left to right; and may help to make sure the mold is fully filled. Other arrangements for introducing material into the molds during manufacture of midsole 202 may be used. In some embodiments, other methods of molding may be utilized including, but not limited to, compression molding, injection molding, and expansion molding, whereby pellets are placed in a mold and expanded.

During manufacture, because midsole 202 may expand upon removal from its mold, the mold may comprise a smaller size than the desired size of the midsole. For example, in one embodiment of the present invention using EVA material, the mold may comprise about 65% to about 75% of the size of the finished midsole. Depending on the expansion ratio of the material used, other mold sizes may be used.

Midsole 202 may be molded to tailor to various needs such as, for example, to prevent pronation or supination. In such instances, certain areas of midsole 202 may be imparted with different characteristics in order to achieve such customizations. In instances where a medial side of midsole 202 needs to be customized and not a lateral side or vice versa, it may be preferred to utilize a midsole 202 with lateral midsole piece 214 and medial midsole piece 216, as described above. As an alternative to, or in addition to, modifying midsole 202, inserts may be placed between midsole 202 and plate 300, as discussed in more detail below, or posts may be utilized to connect midsole 202 to upper 400.

The embodiments of FIGS. 1-4 and 6-10, have illustrated midsole 202 as undulating with peaks 204 and troughs 206 from toe to heel, however this is merely exemplary. In some embodiments, as shown for example in FIGS. 14 and 15, midsole 202 may undulate with peaks 204 and troughs 206 only in a forefoot region. In other embodiments, as shown for example in FIGS. 16-18, midsole 202 may undulate with peaks 204 and troughs 206 only in a heel region. In other embodiments, as shown for example in FIG. 19, midsole 202 may also have one or more rows 334 that undulate with peaks 204 and troughs 206 in a medial to lateral direction. In some embodiments, peaks 204 and troughs 206 of each row 334 may be aligned.

In certain embodiments, undulating sole 200 may be manufactured to provide a different and unique ride and/or feel to article of footwear 100, while also providing a unique aesthetic appeal and improved cushioning and support.

With reference to FIGS. 20-22, embodiments of the present invention may include one or more inserts 500 to provide the desired stiffness and/or cushioning properties of midsole 202. For example, one or more inserts 500 may be included to make all or a portion of midsole 202 more stiff. In this manner, for example, insert 500 may help in limiting pronation or supination of the foot of the wearer.

In one embodiment, insert 500 may include one or more support elements 510 connected by connecting members 520. In one embodiment, support element 510 includes a support surface 511 that is curved such that the support element 510 is substantially u-shaped, as shown, for example, in FIG. 22. As shown in FIG. 20, in one embodiment support element 510 may include a proximate end 512 and a distal end 514. The proximate end 512 may be rounded and the height of support element 510 may gradually decrease from proximate end 512 to distal end 514.

Each support element 510 may be connected to an adjacent support element 510 by a connecting member 520. In one embodiment, connecting member 520 extends from the distal end 514 of one support element 510 to the distal end 514 of an adjacent support element 510. In alternative embodiments, connecting member 520 may extend from the distal end 514 of a first support element 510 to the proximate end 512 of an adjacent support element. In other embodiments, the connecting member 520 may extend from any point along the length of a first support element 510 to any point along the length of an adjacent support element 510. Connecting member 520 may connect support elements that are not adjacent. In one embodiment, support elements 510 disposed at an end of the insert 500 may include a connecting member 522 that does not connect to an adjacent support element. For example, forefoot end support element 516 and rearfoot end support element 518, as shown in FIG. 20, may include a connecting member 522 that is not connected at one end. Alternatively, insert 500 may not include connecting members 522 extending from end support elements. In one embodiment, as shown, for example in FIGS. 20-22, insert 500 may include five (5) connected support elements 510. As will be discussed in detail below, other combinations of support elements 510 and connecting members 520 for an insert 500 may be used to provide the desired stiffness and/or cushioning of midsole 202.

With reference to FIGS. 23 and 24, in one embodiment, insert 500 may be disposed between midsole 202 and plate 300 and may be coupled to midsole 202. In particular, in one embodiment, each support element 510 of insert 500 may be disposed within a gap 210 of midsole 202. For example, as shown in FIG. 23, in an embodiment of an insert 500 having five (5) support elements 510, each of the support elements 510 may be disposed in a gap 210. The support surface 511 of support element 510 is preferably contoured to fit snugly within gap 210 along an interior surface 211 of the gap 210. The support surface 211 may cover all or a portion of the interior surface 211 of the gap 210 where the support element 510 is located. For example, in one embodiment support surface 511 may extend from the bottom 207 of gap 210 partially (e.g., half way) up interior wall 209 or to the top of interior wall 209. In one embodiment, support element 510 may not extend completely into gap 210 such that it does not contact the bottom 207 of gap 210. The support surface 511 may cover only a portion of interior wall 209 between bottom 207 and the top of interior wall 209.

In one embodiment, support surface 511 is curved such that the support element 510 is substantially u-shaped. In other embodiments, support surface 511 may be square, v-shaped, omega-shaped, or otherwise shaped to fit within gap 210 or other portion of midsole 202. In one embodiment, support element 510 may be secured within gap 210 by adhesive. In other embodiments, adhesive may not be used and the snug fit of the element within the gap may keep it in place.

In one embodiment, as shown in FIG. 23, insert 500 may be generally disposed in the arch region of midsole 202. In other embodiments, insert 500 may be disposed in the forefoot region, the heel region, and/or along the entire length of midsole 202. Generally, insert 500 may be positioned to provide the desired stiffness and/or cushioning of midsole 202.

The size of support element 510 also may be adapted such that support element 510 fits within gap 210. In embodiments of the present invention in which the depth of gaps 210 vary along midsole 202, the size of support elements 510 may likewise vary along insert 500. For example, as discussed above, gaps 210 may be deeper in the heel region of midsole 202, and become more shallow toward the forefoot region of midsole 202. Correspondingly, support elements 510 may be larger in the rearward portion of insert 500 and become smaller toward the forward portion of insert 500. For example, forefoot end support element 516 may be smaller than rearfoot end support element 518.

Insert 500 may be made of a rigid or flexible material to provide the desired stiffness properties of the midsole 202. In one embodiment, the insert 500 comprises TPU. Other suitable materials, including but not limited to, elastomers, thermoplastic elastomers (TPE), foam-like plastics (e.g., Pebax® foam and/or Hytrel® foam), gel-like plastics, foam, metal, or other suitable materials and combinations thereof.

In one embodiment, insert 500 may be injection molded as a unitary piece. In other embodiments, support elements 510 may be molded separately and then attached. In some embodiments, one support element 510 may be made of a different material than another support element 510. For example, a first support element 510 may be made of a stiffer material than a second support element 510 to provide the desired stiffness or cushioning properties to different areas of midsole 202. In one embodiment, insert 500 may be co-molded with midsole 202. For example, insert 500 may be molded and midsole 202 may be molded under insert 500, or insert 500 may be molded directly on midsole 202. In one embodiment, midsole 202 may be molded around insert 500 such that insert 500 is embedded in the midsole. In one embodiment, insert 500 may be integral with plate 300. The plate 300 may extend partially or completely into support element 510.

In one embodiment, one or more support elements 510 of insert 500 may extend across a portion of the width of the midsole 202 to provide desired stiffness properties to a portion of midsole 202. For example, as shown in FIG. 23, support elements 510 may extend inwardly from the medial side of the midsole 202 across a portion of the width of midsole 202. During use, support element 510 may provide support to midsole 202 in this area and may limit compression of the midsole. For example, when midsole 202 is under load, support element 510 may limit compression of the walls 208 around the area of the support element. As a result, insert 500 may impart additional stiffness to the medial side of midsole 202 and may limit, for example, supination of the foot.

In other embodiments, the support elements may extend inwardly from the lateral side of the midsole 202 across a portion of the midsole. In this manner, insert 500 may impart additional stiffness to the lateral side of midsole 202 and may, for example, limit pronation of the foot. In still other embodiments, the insert 500 may extend substantially across the entire width of the midsole 202 such that it may impart desired stiffness or cushioning characteristics across the width of the midsole. In some embodiments, insert 500 may include one or more support elements 510 that extend only across a portion of the width of midsole 202 and one or more support elements 510 that extend across the entire width of midsole 202.

In one embodiment, connecting member 520 may be substantially flat such that it does not interfere with placement of plate 300 on midsole 202. A groove may be formed in the top of midsole 202 to receive connecting member 520 such that connecting member 520 is flush with the top of midsole 202. As shown in FIG. 23, connecting members 520 of insert 500 may collectively form a generally curved shape from the perimeter of midsole 202 through an interior portion of the midsole 202. In one embodiment, connecting members 520 may be positioned to provide additional support to the insert 500.

In one embodiment, as shown in FIG. 24, all or a portion of the insert 500 may be visible from the side of footwear 100. For example, proximate end 512 of one or more support elements 510 may be visible through gaps 210. In other embodiments, insert 500 may not be visible.

Any number of support elements 510 and connecting members 520 for an insert 500 may be used to provide the desired stiffness or cushioning properties of midsole 202. As shown in FIG. 25, in one embodiment insert 500 may include two (2) support elements 510. The support elements 510 may be sized for use in the heel portion of midsole 202. In one embodiment, as shown in FIG. 26, insert 500 may include two (2) support elements 510 generally sized for use in the forefoot portion of the midsole 202. In one embodiment, as shown in FIG. 27, insert 500 may include one support element. In yet other embodiments, insert 500 may comprise a single support element 510 without connecting members 520. As shown in FIGS. 28-29, in one embodiment insert 500 may include four (4) support elements 510 that extend substantially across the width of the midsole 202. Connecting members 520 may connect adjacent support elements 520 at the middle of the support element. In one embodiment, the number of support elements 510 may be the same as the number of gaps 210 in midsole 202.

In an alternative embodiment, insert 500 may be disposed on the underside of midsole 202. Each support element 510 of insert 500 may be disposed within gap 212 of midsole 202. The support elements 510 may be sized and shaped accordingly. In other embodiments, insert 500 may include one or more support elements 510 adapted to fit snugly on peak 204.

In a preferred embodiment, insert 500 may be permanently disposed in midsole 202 during manufacture of footwear 100. In other embodiments, insert 500 may be readily removable from midsole 202. For example, in one embodiment, a support element 510 may be inserted into gap 210 between midsole 202 and plate 300 from the side of footwear 100. The support element 510 may include a tab that may be pulled to subsequently remove the support element 510 from gap 210. In this manner, inserts 500 or support elements 510 may be sold "after-market", and a user may continually customize the stiffness or cushioning properties of footwear 100 depending on desired uses, aging of the shoe, or other conditions of use.

In one embodiment, one or more support elements 510 may be solid elements. For example, as shown in FIG. 30, a support element 510 may be completely solid, as shown by support element 513, or may be partially solid, as shown by support elements 515 and 517. The solid support elements may be filled with the same material as the support surface 511 and formed as a unitary piece, or may be filled with a different material, such as, for example, foam or other suitable material. In one embodiment, support element 510 may be filled with a portion of plate 300. The solid support elements may be adapted to provide additional support to midsole 202. In other embodiments, support element 510 may be hollow, fluid filled, or filled with pressurized or ambient air.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

an undulating foam sole, comprising:

a top side, a bottom side opposite the top side, a plurality of spaced apart peaks extending along the top side from a heel end of the top side to a toe end of the top side, each peak extending across a portion of a width of the sole, wherein at least one pair of adjacent peaks define a first gap substantially devoid of material between adjacent peaks, and a plurality of spaced apart troughs extending along the bottom side from a heel end of the bottom side to a toe end of the bottom side, each trough extending across a portion of the width of the sole, wherein at least one pair of adjacent troughs define a second gap substantially devoid of material between adjacent troughs; and a support element disposed in at least one of the first gap or the second gap and coupled to said sole for providing support thereto.

2. The article of footwear of claim 1, wherein the support element is disposed in the first gap.

3. The article of footwear of claim 1, wherein the support element is disposed in the second gap.

4. The article of footwear of claim 1, further comprising:

a plurality of gaps defined by adjacent peaks; and a plurality of gaps defined by adjacent troughs.

5. The article of footwear according to claim 4, further comprising a plurality of support elements, each disposed in a gap defined by adjacent peaks of the top side of the sole.

6. The article of footwear according to claim 5, wherein the plurality of support elements comprises two support elements.

7. The article of footwear according to claim 5, wherein the plurality of support elements comprises three support elements.

8. The article of footwear according to claim 5, wherein the plurality of support elements comprises four support elements.

9. The article of footwear according to claim 5, wherein the plurality of support elements comprises five support elements.

10. The article of footwear according to claim 5, wherein a support element is disposed in each of the plurality of gaps in the top side of the sole.

11. The article of footwear according to claim 5, wherein the plurality of support elements are connected.

12. The article of footwear of claim 1, wherein the support element is disposed on a medial side of the sole.

13. The article of footwear of claim 1, wherein the support element is disposed on a lateral side of the sole.

14. The article of footwear of claim 1, wherein the support element extends across only a portion of the width of the sole.

15. The article of footwear of claim 1, wherein the support element extends across the entire width of the sole.

16. The article of footwear of claim 1, wherein the support element is substantially u-shaped.

17. The article of footwear of claim 1, wherein the support element fits snugly in the first gap or the second gap.

18. The article of footwear of claim 1, wherein the support element is attached to the sole with adhesive.

19. The article of footwear of claim 1, wherein the support element is removable from the sole.

20. The article of footwear of claim 1, further comprising:

an upper; and a plate connected to the upper, wherein at least a portion of the top side of the sole is connected to the plate.

21. The article of footwear of claim 20, wherein the support element is integral with the plate.

22. The article of footwear of claim 2, wherein a portion of at least one peak is directly connected to the plate.

23. The article of footwear of claim 20, wherein the support element is disposed between the sole and the plate.

24. The article of footwear of claim 1, wherein the support element is contoured to fit along an interior surface of the first gap or the second gap.

25. The article of footwear of claim 1, further comprising an upper, wherein at least a portion of the top side of the sole is connected to the upper.

* * * * *

UNITED STATES PATENT AND TRADEMARK OFFICE

CERTIFICATE OF CORRECTION

PATENT NO. : 9,015,962 B2
APPLICATION NO. : 12/748246
DATED : April 28, 2015
INVENTOR(S) : Matthew Boudreau et al.

It is certified that error appears in the above-identified patent and that said Letters Patent is hereby corrected as shown below:

Page 4, Column 2, line 13, References Cited, "Partial European Search Report, European Patent Office," should read --Partial European Search Report for application 10170301.5, European Patent Office,--.

In the claims,

Column 12, line 40, Claim 22: "The article of footwear of claim 2" should read --The article of footwear of claim 20--.

Signed and Sealed this
Twentieth Day of October, 2015

Michelle K. Lee

Michelle K. Lee
*Director of the United States Patent and Trademark Office*